US009774975B2

(12) United States Patent
Krueger et al.

(10) Patent No.: US 9,774,975 B2
(45) Date of Patent: Sep. 26, 2017

(54) METHOD AND APPARATUS FOR DECODING A COMPRESSED HOA REPRESENTATION, AND METHOD AND APPARATUS FOR ENCODING A COMPRESSED HOA REPRESENTATION

(71) Applicant: Dolby Laboratories Licensing Corporation, San Francisco, CA (US)

(72) Inventors: Alexander Krueger, Hannover (DE); Sven Kordon, Wunstorf (DE)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/320,461

(22) PCT Filed: Jul. 2, 2015

(86) PCT No.: PCT/EP2015/065086

§ 371 (c)(1),
(2) Date: Dec. 20, 2016

(87) PCT Pub. No.: WO2016/001356

PCT Pub. Date: Jan. 7, 2016

(65) Prior Publication Data

US 2017/0164131 A1 Jun. 8, 2017

(30) Foreign Application Priority Data

Jul. 2, 2014 (EP) ..... 14306080
Nov. 20, 2014 (EP) ..... 14194186

(51) Int. Cl.
*H04R 5/00* (2006.01)
*H04S 3/02* (2006.01)
(Continued)

(52) U.S. Cl.
CPC ..... *H04S 3/02* (2013.01); *G10L 19/008* (2013.01); *G10L 19/0204* (2013.01);
(Continued)

(58) Field of Classification Search
USPC .... 381/17, 22, 71.14, 94.3, 98, 99, 356, 402
See application file for complete search history.

(56) References Cited

U.S. PATENT DOCUMENTS 9,454,971 B2 9/2016 Batke
2014/0016784 A1* 1/2014 Sen ..... G10L 19/008 381/17
(Continued)

FOREIGN PATENT DOCUMENTS

EP 2469741 6/2012
EP 2 743 922 * 12/2012 ..... G10L 19/08
(Continued)

OTHER PUBLICATIONS

Fliege, Jorg, "A two-stage approach for computing cubature Formulae for the Sphere", Technical Report, Fachbereich Mathematik, Univerity Dortmund, 1999, pp. 1-31.
(Continued)

*Primary Examiner* — Yosef K Laekemariam

(57) ABSTRACT

Encoding of Higher Order Ambisonics (HOA) signals commonly results in high data rates. A method for low bit-rate encoding frames of an input HOA signal having coefficient sequences comprises computing (s110) a truncated HOA representation ($C_T(k)$), determining (s111) active coefficient sequences ($I_{c,Act}(k)$), estimating (s16) candidate directions ($M_{DIR}(k)$), dividing (s15) the input HOA signal into a plurality of frequency subbands ($f_1, \ldots, f_F$), estimating (s161) for each of the frequency subbands a subset of candidate directions ($M_{DIR}(k)$) as active directions ($M_{DIR}(k,f1), \ldots, M_{DIR}(k,f_F)$) and for each active direction a trajectory, computing (s17) for each frequency subband directional subband signals from the coefficient sequences of
(Continued)

the frequency subband according to the active directions, calculating (s18) for each frequency subband a prediction matrix ($A(k,f_1), \ldots, A(k,f_F)$) that can be used for predicting the directional subband signals from the coefficient sequences of the frequency subband using the respective active coefficient sequences ($Ic,_{ACT}(k)$), and encoding (s19) the candidate directions, active directions, prediction matrices and truncated HOA representation.

24 Claims, 7 Drawing Sheets

(51) Int. Cl.
*H04S 3/00* (2006.01)
*G10L 19/008* (2013.01)
*G10L 19/02* (2013.01)

(52) U.S. Cl.
CPC ..... *H04S 3/008* (2013.01); *H04S 2420/07* (2013.01); *H04S 2420/11* (2013.01)

(56) References Cited

U.S. PATENT DOCUMENTS

| | | | |
|---|---|---|---|
| 2015/0332679 | A1 | 11/2015 | Kruger |
| 2016/0088415 | A1 | 3/2016 | Krueger |
| 2016/0150341 | A1 | 5/2016 | Kordon |

FOREIGN PATENT DOCUMENTS

| | | |
|---|---|---|
| EP | 2665208 | 11/2013 |
| EP | 2738962 | 6/2014 |
| EP | 2743922 | 6/2014 |
| EP | 2800401 | 11/2014 |
| EP | 2824661 | 1/2015 |

OTHER PUBLICATIONS

ISO/IEC JTC1/SC29/WG11 N14264, "WD1-HOA Text of MPEG-H 3D Audio" Coding of Moving Pictures and Audio, Jan. 2014, pp. 1-86.

Jerome Daniel, "Representation de Champs Acoustiques, application a la transmission et a la reproduction de scenes Sonores Complexes dans un Context Multimedia" Jul. 31, 2001.

Lee, D.D. et al "Learning the Parts of Objects by Non-Negative Matrix Factorization" Nature, vol. 401, Oct. 21, 1999, MacMillan Magazines Ltd. pp. 788-791.

Rafaely, Boaz "Plane Wave Decomposition of the Sound Field on a Sphere by Spherical Convolution" ISVR Technical Memorandum 910, May 2003, pp. 1-40.

Williams, Earl, "Fourier Acoustics" Chapter 6 Spherical Waves, pp. 183-186, Jun. 1999.

* cited by examiner

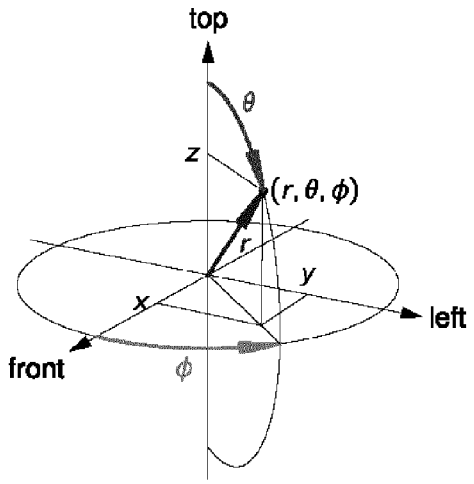
Fig.6
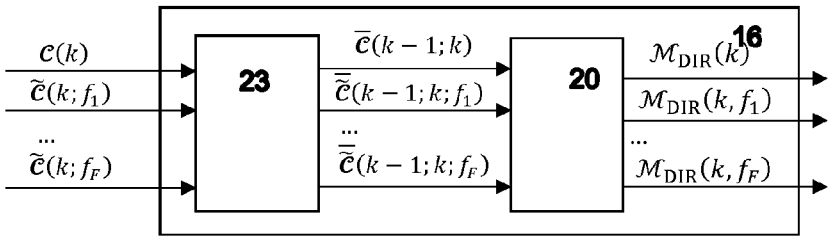
Fig.7
$\mathbf{M_{DIR}(k)=\{\Omega_3, \Omega_8, \Omega_{52}, \Omega_{101}, \Omega_{229}, \Omega_{446}, \Omega_{581}\}}$
| | k-2 | k-1 | k | k+1 |
|---|---|---|---|---|
| $T_1$ | x | x | x | x |
| $T_2$ | x | x | x | x |
| $T_3$ | | x | x | |
| $T_4$ | | x | | x |
| $T_5$ | | | x | |
| $T_6$ | x | | | |
| ... | | | | |
frame
$\mathbf{M_{DIR}(k,f_1)=\{(1,\Omega_{52}),\ (2,\Omega_{229}),\ (3,\Omega_3),\ (5,\Omega_{581})\}}$
$\mathbf{M_{DIR}(k,f_2)=\{(1,\Omega_{52}),\ (2,\Omega_{229})\}}$
...
Fig.8

METHOD AND APPARATUS FOR DECODING A COMPRESSED HOA REPRESENTATION, AND METHOD AND APPARATUS FOR ENCODING A COMPRESSED HOA REPRESENTATION

This invention relates to a method for encoding frames of an input HOA signal having a given number of coefficient sequences, a method for decoding a HOA signal, an apparatus for encoding frames of an input HOA signal having a given number of coefficient sequences, and an apparatus for decoding a HOA signal.

BACKGROUND

Higher Order Ambisonics (HOA) offers one possibility to represent three-dimensional sound, among other techniques like wave field synthesis (WFS) or channel based approaches like the one known as "22.2". In contrast to channel based methods, a HOA representation offers the advantage of being independent of a specific loudspeaker set-up. This flexibility comes at the expense of a decoding process that is required for the playback of the HOA representation on a particular loudspeaker set-up. Compared to the WFS approach, where the number of required loudspeakers is usually very large, HOA may also be rendered to set-ups consisting of only few loudspeakers. A further advantage of HOA is that the same representation can also be employed without any modification for binaural rendering to head-phones.

HOA is based on the representation of the so-called spatial density of complex harmonic plane wave amplitudes by a truncated Spherical Harmonics (SH) expansion. Each expansion coefficient is a function of angular frequency, which can be equivalently represented by a time domain function. Hence, without loss of generality, the complete HOA sound field representation actually can be understood as consisting of 0 time domain functions, where 0 denotes the number of expansion coefficients. These time domain functions will be equivalently referred to as HOA coefficient sequences or as HOA channels in the following.

The spatial resolution of the HOA representation improves with a growing maximum order N of the expansion. Unfortunately, the number of expansion coefficients O grows quadratically with the order N, and in particular $O=(N+1)^2$. For example, typical HOA representations using order N=4 require O=25 HOA (expansion) coefficients. According to the above considerations, a total bit rate for the transmission of a HOA representation, given a desired single-channel sampling rate $f_S$ and the number of bits $N_b$ per sample, is determined by $O \cdot f_S \cdot N_b$. Consequently, transmitting a HOA representation e.g. of order N=4 with a sampling rate of $f_S$=48 kHz employing $N_b$=16 bits per sample results in a bit rate of 19.2 MBits/s, which is very high for many practical applications such as e.g. streaming. Thus, a compression of HOA representations is highly desirable. Various approaches for compression of HOA sound field representations were proposed in [4, 5, 6]. These approaches have in common that they perform a sound field analysis and decompose the given HOA representation into a directional and a residual ambient component. The final compressed representation comprises, on the one hand, a number of quantized signals, resulting from the perceptual coding of so called directional and vector-based signals as well as relevant coefficient sequences of the ambient HOA component. On the other hand, it comprises additional side information related to the quantized signals, which is necessary for the reconstruction of the HOA representation from its compressed version.

A reasonable minimum number of quantized signals for the approaches [4, 5, 6] is eight. Hence, the data rate with one of these methods is typically not lower than 256 kbit/s, assuming a data rate of 32 kbit/s for each individual perceptual coder. For certain applications, like e.g. audio streaming to mobile devices, this total data rate might be too high. Thus, there is a demand for HOA compression methods addressing distinctly lower data rates, e.g. 128 kbit/s.

SUMMARY OF THE INVENTION

A new method and apparatus for a low bit-rate compression of Higher Order Ambisonics (HOA) representations of sound fields is disclosed.

One main aspect of the low-bit rate compression method for HOA representations of sound fields is to decompose the HOA representation into a plurality of frequency sub-bands, and approximate coefficients within each frequency subband (ie. sub-band) by a combination of a truncated HOA representation and a representation that is based on a number of predicted directional subband signals.

The truncated HOA representation comprises a small number of selected coefficient sequences, where the selection is allowed to vary over time. E.g. a new selection is made for every frame. The selected coefficient sequences to represent the truncated HOA representation are perceptually coded and are a part of the final compressed HOA representation. In one embodiment, the selected coefficient sequences are de-correlated before perceptual coding, in order to increase the coding efficiency and to reduce the effect of noise unmasking at rendering. A partial de-correlation is achieved by applying a spatial transform to a predefined number of the selected HOA coefficient sequences. For decompression, the de-correlation is reversed by re-correlation. A great advantage of such partial de-correlation is that no extra side information is required to revert the de-correlation at decompression.

The other component of the approximated HOA representation is represented by a number of directional subband signals with corresponding directions. These are coded by a parametric representation that comprises a prediction from the coefficient sequences of the truncated HOA representation. In an embodiment, each directional subband signal is predicted (or represented) by a scaled sum of the coefficient sequences of the truncated HOA representation, where the scaling is, in general, complex valued. In order to be able to re-synthesize the HOA representation of the directional subband signals for decompression, the compressed representation contains quantized versions of the complex valued prediction scaling factors as well as quantized versions of the directions.

In one embodiment, a method for encoding (and thereby compressing) frames of an input HOA signal having a given number of coefficient sequences, where each coefficient sequence has an index, comprises steps of determining a set of indices of active coefficient sequences $I_{C,ACT}(k)$ to be included in a truncated HOA representation, computing the truncated HOA representation $C_T(k)$ having a reduced number of non-zero coefficient sequences (i.e. less non-zero coefficient sequences and thus more zero coefficient sequences than the input HOA signal), estimating from the input HOA signal a first set of candidate directions $M_{DIR}(k)$, dividing the input HOA signal into a plurality of frequency subbands, wherein coefficient sequences $\tilde{\tilde{C}}(k-1, k, f_{1,\ldots,F})$ of the frequency subbands are obtained, estimating for each of the frequency subbands a second set of directions $M_{DIR}(k,f_1), \ldots, M_{DIR}(k,f_F)$, wherein each element of the second set of directions is a tuple of indices with a first and a second index, the second index being an index of an active direction for a current frequency subband and the first index being a trajectory index of the active direction, wherein each active direction is also included in the first set of candidate directions $M_{DIR}(k)$ of the input HOA signal (i.e. active subband directions in the second set of directions are a subset of the first set of full band directions), for each of the frequency subbands, computing directional subband signals $\tilde{\tilde{X}}(k-1, k, f_1), \ldots, \tilde{\tilde{X}}(k-1, k, f_F)$ from the coefficient sequences $\tilde{\tilde{C}}(k-1, k, f_{1,\ldots,F})$ of the frequency subband according to the second set of directions $M_{DIR}(k,f_1), \ldots, M_{DIR}(k,f_F)$ of the respective frequency subband, for each of the frequency subbands, calculating a prediction matrix $A(k,f_1), \ldots, A(k,f_F)$ that is adapted for predicting the directional subband signals $\tilde{\tilde{X}}(k-1, k, f_{1,\ldots,F})$ from the coefficient sequences $\tilde{\tilde{C}}(k-1, k, f_{1,\ldots,F})$ of the frequency subband using the set of indices of active coefficient sequences $I_{C,ACT}(k)$ of the respective frequency subband, and encoding the first set of candidate directions $M_{DIR}(k)$, the second set of directions $M_{DIR}(k,f_1), \ldots, M_{DIR}(k,f_F)$, the prediction matrices $A(k,f_1), \ldots, A(k,f_F)$ and the truncated HOA representation $C_T(k)$.

The second set of directions relates to frequency subbands. The first set of candidate directions relates to the full frequency band. Advantageously, in the step of estimating for each of the frequency subbands the second set of directions, the directions $M_{DIR}(k,f_1), \ldots, M_{DIR}(k,f_F)$ of a frequency subband need to be searched only among the directions $M_{DIR}(k)$ of the full band HOA signal, since the second set of subband directions is a subset of the first set of full band directions. In one embodiment, the sequential order of the first and second index within each tuple is swapped, ie. the first index is an index of an active direction for a current frequency subband and the second index is a trajectory index of the active direction.

A complete HOA signal comprises a plurality of coefficient sequences or coefficient channels. A HOA signal in which one or more of these coefficient sequences are set to zero is called a truncated HOA representation herein. Computing or generating a truncated HOA representation comprises generally a selection of coefficient sequences that will or will not be set to zero. This selection can be made according to various criteria, e.g. by selecting as coefficient sequences not to be set to zero those that comprise a maximum energy, or those that are perceptually most relevant, or selecting coefficient sequences arbitrarily etc. Dividing the HOA signal into frequency subbands can be performed by Analysis Filter banks, comprising e.g. Quadrature Mirror Filters (QMF).

In one embodiment, encoding the truncated HOA representation $C_T(k)$ comprises partial decorrelation of the truncated HOA channel sequences, channel assignment for assigning the (correlated or decorrelated) truncated HOA channel sequences $y_1(k), \ldots, y_I(k)$ to transport channels, performing gain control on each of the transport channels, wherein gain control side information $e_i(k-1)$, $\beta_i(k-1)$ for each transport channel is generated, encoding the gain controlled truncated HOA channel sequences $z_1(k), \ldots, z_I(k)$ in a perceptual encoder, encoding the gain control side information $e_i(k-1)$, $\beta_i(k-1)$, the first set of candidate directions $M_{DIR}(k)$, the second set of directions $M_{DIR}(k,f_1), \ldots, M_{DIR}(k,f_F)$ and the prediction matrices $A(k,f_1), \ldots, A(k,f_F)$ in a side information source coder, and multiplexing the outputs of the perceptual encoder and the side information source coder to obtain an encoded HOA signal frame $\breve{\boldsymbol{B}}(k-1)$.

In one embodiment, a computer readable medium has stored thereon executable instructions to cause a computer to perform said method for encoding or compressing frames of an input HOA signal.

In one embodiment, an apparatus for frame-wise encoding (and thereby compressing) frames of an input HOA signal having a given number of coefficient sequences, where each coefficient sequence has an index comprises a processor and a memory for a software program that when executed on the processor performs steps of the above-described method for encoding or compressing frames of an input HOA signal.

Further, in one embodiment, a method for decoding (and thereby decompressing) a compressed HOA representation comprises extracting from the compressed HOA representation a plurality of truncated HOA coefficient sequences $\hat{z}_1(k), \ldots, \hat{z}_I(k)$, an assignment vector $v_{AMB,ASSIGN}(k)$ indicating (or containing) sequence indices of said truncated HOA coefficient sequences, subband related direction information $M_{DIR}(k+1,f_1), \ldots, M_{DIR}(k+1,f_F)$, a plurality of prediction matrices $A(k+1,f_1), \ldots, A(k+1,f_F)$, and gain control side information $e_1(k), \beta_1(k), \ldots, e_I(k), \beta_I(k)$, reconstructing a truncated HOA representation $\hat{C}_T(k)$ from the plurality of truncated HOA coefficient sequences $\hat{z}_1(k), \ldots, \hat{z}_I(k)$, the gain control side information $e_1(k), \beta_1(k), \ldots, e_I(k), \beta_I(k)$ and the assignment vector $v_{AMB,ASSIGN}(k)$, decomposing in Analysis Filter banks the reconstructed truncated HOA representation $\hat{C}_T(k)$ into frequency subband representations $\hat{\tilde{\boldsymbol{c}}}_T(k, f_1), \ldots, \hat{\tilde{\boldsymbol{c}}}_{T\,T}(k, f_F)$ for a plurality of F frequency subbands, synthesizing in Directional Subband Synthesis blocks for each of the frequency subband representations a predicted directional HOA representation $\hat{\tilde{\boldsymbol{c}}}_D(k, f_1), \ldots, \hat{\tilde{\boldsymbol{c}}}_D(k, f_F)$ from the respective frequency subband representation $\hat{\tilde{\boldsymbol{c}}}_T(k, f_1), \ldots, \hat{\tilde{\boldsymbol{c}}}_T(k, f_F)$ of the reconstructed truncated HOA representation, the subband related direction information $M_{DIR}(k+1,f_1), \ldots, M_{DIR}(k+1, f_F)$ and the prediction matrices $A(k+1,f_1), \ldots, A(k+1,f_F)$, composing in Subband Composition blocks for each of the F frequency subbands a decoded subband HOA representation $\hat{\tilde{\boldsymbol{c}}}(k, f_1), \ldots, \hat{\tilde{\boldsymbol{c}}}(k, f_F)$ with coefficient sequences $\hat{\tilde{\boldsymbol{c}}}_n(k, f_j)$, n=1, . . . , 0 that are either obtained from coefficient sequences of the truncated HOA representation $\hat{\tilde{\boldsymbol{c}}}_T(k, f_j)$ if the coefficient sequence has an index n that is included in (ie. an element of) the assignment vector $v_{AMB,ASSIGN}(k)$, or otherwise obtained from coefficient sequences of the predicted directional HOA component $\hat{\tilde{\boldsymbol{c}}}_D(k, f_j)$ provided by one of the Directional Subband Synthesis blocks, and synthesizing in Synthesis Filter banks the decoded subband HOA representations $\hat{\tilde{\boldsymbol{c}}}(k, f_1), \ldots, \hat{\tilde{\boldsymbol{c}}}(k, f_F)$ to obtain the decoded HOA representation $\hat{C}(k)$.

In one embodiment, the extracting comprises demultiplexing the compressed HOA representation to obtain a perceptually coded portion and an encoded side information portion. In one embodiment, the perceptually coded portion comprises perceptually encoded truncated HOA coefficient sequences $\check{z}_1(k), \ldots, \check{z}_I(k)$ and the extracting comprises decoding in a perceptual decoder the perceptually encoded truncated HOA coefficient sequences $\check{z}_1(k), \ldots, \check{z}_I(k)$ to obtain the truncated HOA coefficient sequences $\hat{z}_1(k), \ldots, \hat{z}_I(k)$. In one embodiment, the extracting comprises decoding in a side information source decoder the encoded side information portion to obtain the set of subband related directions $M_{DIR}(k+1, f_1), \ldots, M_{DIR}(k+1,f_F)$, prediction matrices $A(k+1,f_1), \ldots, A(k+1,f_F)$, gain control side information $e_1(k), \beta_1(k), \ldots, e_I(k), \beta_I(k)$ and assignment vector $v_{AMB,ASSIGN}(k)$.

In one embodiment, a computer readable medium has stored thereon executable instructions to cause a computer to perform said method for decoding of directions of dominant directional signals.

In one embodiment, an apparatus for frame-wise decoding (and thereby decompressing) a compressed HOA representation comprises a processor and a memory for a software program that when executed on the processor performs steps of the above-described method for decoding or decompressing frames of an input HOA signal.

In one embodiment, an apparatus for decoding a HOA signal comprises a first module configured to receive indices of a maximum number of directions D for a HOA signal representation to be decoded, a second module configured to reconstruct directions of a maximum number of directions D of the HOA signal representation to be decoded, a third module configured to receive indices of active direction signals per subband, a fourth module configured to reconstruct active direction signals per subband from the reconstructed directions D of the HOA signal representation to be decoded, and a fifth module configured to predict directional signals of subbands, wherein the predicting of a directional signal in a current frame of a subband comprises determining directional signals of a preceding frame of the subband, and wherein a new directional signal is created if the index of the directional signal was zero in the preceding frame and is non-zero in the current frame, a previous directional signal is cancelled if the index of the directional signal was non-zero in the preceding frame and is zero in the current frame, and a direction of a directional signal is moved from a first to a second direction if the index of the directional signal changes from the first to the second direction.

The subbands are generally obtained from a complex valued filter bank. One purpose of the assignment vector is to indicate sequence indices of coefficient sequences that are transmitted/received, and thus contained in the truncated HOA representation, so as to enable an assignment of these coefficient sequences to the final HOA signal. In other words, the assignment vector indicates, for each of the coefficient sequences of the truncated HOA representation, to which coefficient sequence in the final HOA signal it corresponds. For example, if a truncated HOA representation contains four coefficient sequences and the final HOA signal has nine coefficient sequences, the assignment vector may be [1,2,5,7] (in principle), thereby indicating that the first, second, third and fourth coefficient sequence of the truncated HOA representation are actually the first, second, fifth and seventh coefficient sequence in the final HOA signal.

Further objects, features and advantages of the invention will become apparent from a consideration of the following description and the appended claims when taken in connection with the accompanying drawings.

BRIEF DESCRIPTION OF THE DRAWINGS

Exemplary embodiments of the invention are described with reference to the accompanying drawings, which show in FIG. 1 an architecture of a spatial HOA encoder,
FIG. 2 an architecture of a direction estimation block,
FIG. 3 a perceptual side information source encoder,
FIG. 4 a perceptual side information source decoder,
FIG. 5 an architecture of a spatial HOA decoder,
FIG. 6 a spherical coordinate system,
FIG. 7 a direction estimation processing block,
FIG. 8 directions, a trajectory index set and coefficients of a truncated HOA representation,
FIG. 9 a conventional audio encoder as used in MPEG,
FIG. 10 an improved audio encoder as usable in MPEG,
FIG. 11 a conventional audio decoder as used in MPEG,
FIG. 12 an improved audio decoder as usable in MPEG,
FIG. 13 a flow-chart of an encoding method, and
FIG. 14 a flow-chart of a decoding method.

DETAILED DESCRIPTION OF PREFERRED EMBODIMENTS

One main idea of the proposed low-bit rate compression method for HOA representations of sound fields is to approximate the original HOA representation frame-wise and frequency subband-wise, i.e. within individual frequency subbands of each HOA frame, by a combination of two portions: a truncated HOA representation and a representation based on a number of predicted directional subband signals. A summary of HOA basics is provided further below.

The first portion of the approximated HOA representation is a truncated HOA version that consists of a small number of selected coefficient sequences, where the selection is allowed to vary over time (e.g. from frame to frame). The selected coefficient sequences to represent the truncated HOA version are then perceptually coded and are a part of the final compressed HOA representation. In order to increase the coding efficiency and to reduce the effect of noise unmasking at rendering, it is advantageous to de-correlate the selected coefficient sequences before perceptual coding. A partial de-correlation is achieved by applying to a predefined number of the selected HOA coefficient sequences a spatial transform, which means the rendering to a given number of virtual loudspeaker signals. A great advantage of that partial de-correlation is that no extra side information is required to revert the de-correlation at decompression.

The second portion of the approximated HOA representation is represented by a number of directional subband signals with corresponding directions. However, these are not conventionally coded. Instead, they are coded as a parametric representation by means of a prediction from the coefficient sequences of the first portion, i.e. the truncated HOA representation. In particular, each directional subband signal is predicted by a scaled sum of coefficient sequences of the truncated HOA representation, where the scaling is complex valued in general. Both portions together form a compressed representation of the HOA signal, thus achieving a low bit rate. In order to be able to re-synthesize the HOA representation of the directional subband signals for decompression, the compressed representation contains quantized versions of the complex valued prediction scaling factors as well as quantized versions of the directions.

Particularly important aspects in this context are the computation of the directions and of the complex valued prediction scaling factors, and how to code them efficiently.

Low Bit Rate HOA Compression

Figure 1:
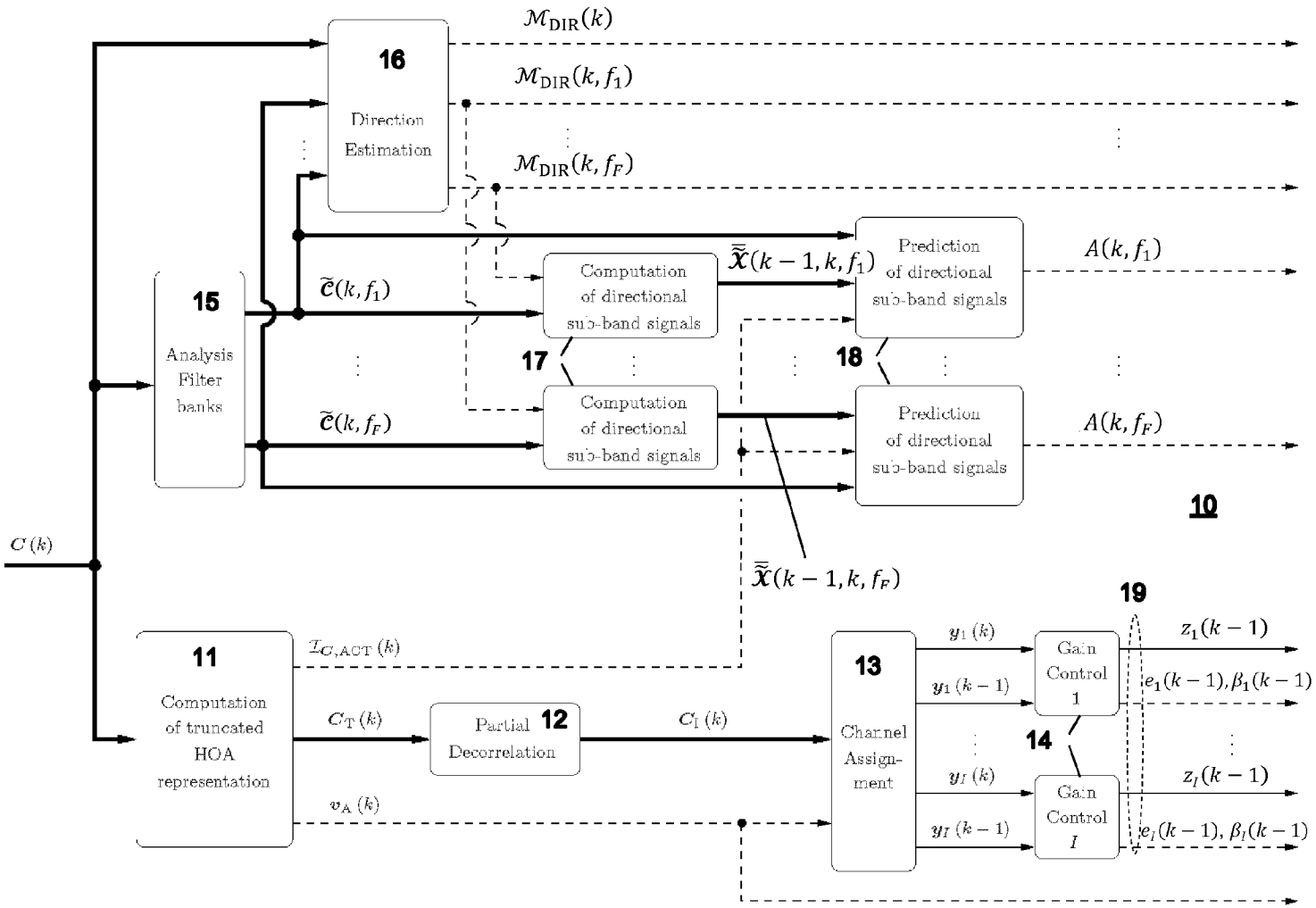
Figure 3:
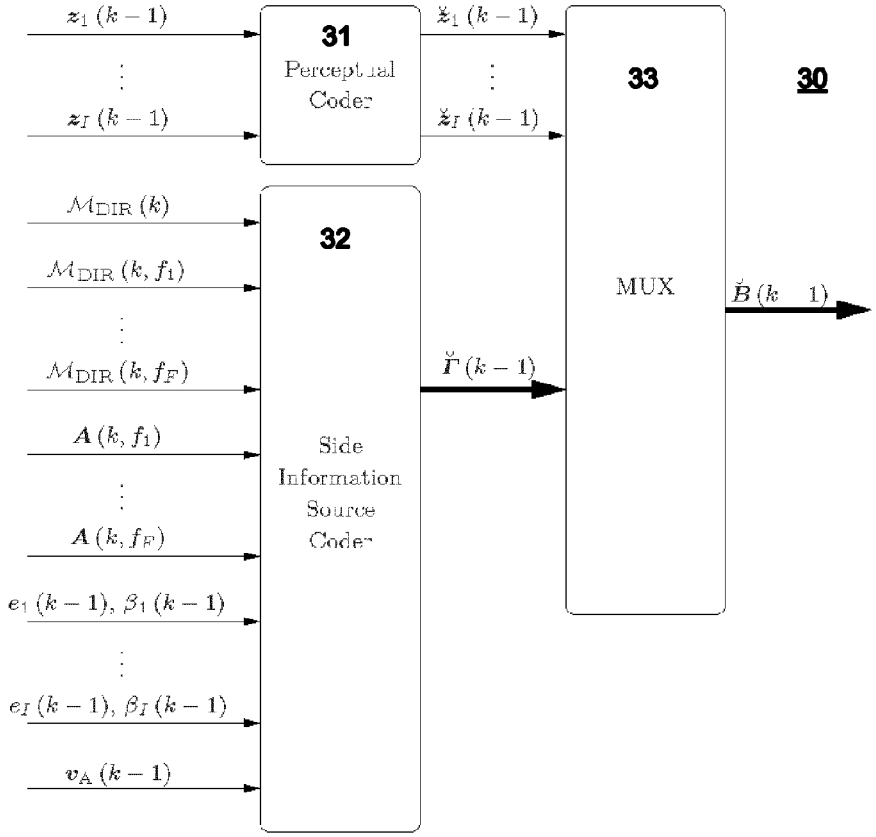

For the proposed low bit rate HOA compression, a low bit rate HOA compressor can be subdivided into a spatial HOA encoding part and a perceptual and source encoding part. An exemplary architecture of the spatial HOA encoding part is illustrated in FIG. 1, and an exemplary architecture of a perceptual and source encoding part is depicted in FIG. 3. The spatial HOA encoder 10 provides a first compressed HOA representation comprising I signals together with side information that describes how to create a HOA representation thereof. In the Perceptual and Side Information Source Coder 30, these I signals are perceptually encoded in a Perceptual Coder 31, and the side information is subjected to source encoding in a Side Information Source Coder 32. The Side Information Source Coder 32 provides coded side information $\breve{\boldsymbol{\Gamma}}$. Then, the two coded representations provided by the Perceptual Coder 31 and the Side Information Source Coder 32 are multiplexed in a Multiplexer 33 to obtain the low bit rate compressed HOA data stream $\breve{\boldsymbol{B}}$.

Spatial HOA Encoding

The spatial HOA encoder illustrated in FIG. 1 performs frame-wise processing. Frames are defined as portions of O time-continuous HOA coefficient sequences. E.g. a k-th frame C(k) of the input HOA representation to be encoded is defined with respect to the vector c(t) of time-continuous HOA coefficient sequences (cf. eq. (46)) as $$C(k):=[c((kL+1)T_S)\ c((kL+2)T_S)\ \ldots\ c((k+1)LT_S)]\in\mathbb{R}^{O\times L} \tag{1}$$

where k denotes the frame index, L denotes the frame length (in samples), $O=(N+1)^2$ denotes the number of HOA coefficient sequences and $T_S$ indicates the sampling period.

Computation of a Truncated HOA Representation

As shown in FIG. 1, a first step in computing the truncated HOA representation comprises computing 11 from the original HOA frame C(k) a truncated version $C_T(k)$. Truncation in this context means the selection of I particular coefficient sequences out of the O coefficient sequences of the input HOA representation, and setting all the other coefficient sequences to zero. Various solutions for the selection of coefficient sequences are known from [4,5,6], e.g. those with maximum power or highest relevance with respect to human perception. The selected coefficient sequences represent the truncated HOA version. A data set $\mathcal{I}_{C\ ACT}(k)$ is generated that contains the indices of the selected coefficient sequences. Then, as described further below, the truncated HOA version $C_T(k)$ will be partially de-correlated 12, and the partially de-correlated truncated HOA version $C_I(k)$ will be subject to channel assignment 13, where the chosen coefficient sequences are assigned to the available I transport channels. As further described below, these coefficient sequences are then perceptually encoded 30 and are finally a part of the compressed representation. To obtain smooth signals for the perceptual encoding after the channel assignment, coefficient sequences that are selected in the $k^{th}$ frame but not in the $(k+1)^{th}$ frame are determined. Those coefficient sequences that are selected in a frame and will not be selected in the next frame are faded out. Their indices are contained in the data set $\mathcal{I}_{C\ ACT,OUT}(k)$, which is a subset of $\mathcal{I}_{C\ ACT}(k)$. Similarly, coefficient sequences that are selected in the $k^{th}$ frame but were not selected in the $(k-1)^{th}$ frame are faded in. Their indices are contained in the set $\mathcal{I}_{C\ ACT,IN}(k)$, which is also a subset of $\mathcal{I}_{C\ ACT}(k)$. For the fading, a window function $w_{OA}(l)$, l=1, . . . , 2L (such as the one introduced below in eq. (39)) may be used.

Altogether, if a HOA frame k of the truncated version $C_T(k)$ is composed of the L samples of the O individual coefficient sequence frames by $$C_T(k)=\begin{bmatrix} c_{T,1}(k,1) & \ldots & c_{T,1}(k,L) \\ c_{T,2}(k,1) & \ldots & c_{T,2}(k,L) \\ \vdots & \ddots & \vdots \\ c_{T,O}(k,1) & \ldots & c_{T,O}(k,L) \end{bmatrix} \tag{2}$$

then the truncation can be expressed for coefficient sequence indices n=1, . . . , 0 and sample indices l=1, . . . , L by $$c_{T,n}(k)=\begin{cases} c_n(k,l)\cdot w_{OA}(1) & \text{if } n\in\mathcal{I}_{C,ACT,IN}(k) \\ c_n(k,l)\cdot w_{OA}(L+1) & \text{if } n\in\mathcal{I}_{C,ACT,OUT}(k) \\ c_n(k,l) & \text{if } n\in\mathcal{I}_{C,ACT}(k)\setminus\left(\mathcal{I}_{C,ACT,IN}(k)\cup\mathcal{I}_{C,ACT,OUT}(k)\right) \\ 0 & \text{else} \end{cases} \tag{3}$$

There are several possibilities for the criteria for the selection of the coefficient sequences. E.g., one advantageous solution is selecting those coefficient sequences that represent most of the signal power. Another advantageous solution is selecting those coefficient sequences that are most relevant with respect to the human perception. In the latter case the relevance may be determined e.g. by rendering differently truncated representations to virtual loudspeaker signals, determining the error between these signals and virtual loudspeaker signals corresponding to the original HOA representation and finally interpreting the relevance of the error, considering sound masking effects.

A reasonable strategy for selecting the indices in the set $\mathcal{I}_{C\ ACT}(k)$ is, in one embodiment, to select always the first $O_{MIN}$ indices 1, . . . , $O_{MIN}$, where $O_{MIN}=(N_{MIN}+1)^2\leq I$ and $N_{MIN}$ denotes a given minimum full order of the truncated HOA representation. Then, select the remaining $I-O_{MIN}$ indices from the set $\{O_{MIN}+1, \ldots, O_{MAX}\}$ according to one of the criteria mentioned above, where $O_{MAX}=(N_{MAX}+1)^2\leq O$ with $N_{MAX}$ denoting a maximum order of the HOA coefficient sequences that are considered for selection. Note that $O_{MAX}$ is the maximum number of transferable coefficients per sample, which is less than or equal to the total number O of coefficients. According to this strategy, the truncation processing block 11 also provides a so-called assignment vector $v_A(k)\in\mathbb{N}^{I-O_{MIN}}$, whose elements $v_{A,i}(k)$, i=1, . . . , $I-O_{MIN}$, are set according to $$v_{A,i}(k)=n \tag{4}$$

where n (with $n\geq O_{MIN}+1$) denotes the HOA coefficient sequence index of the additionally selected HOA coefficient sequence of C(k) that will later be assigned to the i-th transport signal $y_i(k)$. The definition of $y_i(k)$ is given in eq.(10) below. Thus, the first $O_{MIN}$ rows of $C_T(k)$ comprise by default the HOA coefficient sequences 1, . . . , $O_{MIN}$, and among the following $O-O_{MIN}$ (or $O_{MAX}-O_{MIN}$, if $O=O_{MAX}$) rows of $C_T(k)$, there are $I-O_{MIN}$ rows that comprise frame-wise varying HOA coefficient sequences whose indices are stored in the assignment vector $v_A(k)$. Finally, the remaining rows of $C_T(k)$ comprise zeroes. Consequently, as will be described below, the first (or last, as in eq.(10)) $O_{MIN}$ of the available I transport signals are assigned by default to HOA coefficient sequences 1, . . . , $O_{MIN}$, and the remaining $I-O_{MIN}$ transport signals are assigned to frame-wise varying HOA coefficient sequences whose indices are stored in the assignment vector $v_A(k)$.

Partial De-Correlation

In the second step, a partial de-correlation 12 of the selected HOA coefficient sequences is carried out in order to increase the efficiency of the subsequent perceptual encoding, and to avoid coding noise unmasking that would occur after matrixing the selected HOA coefficient sequences at rendering. An exemplary partial de-correlation 12 is achieved by applying a spatial transform to the first $O_{MIN}$ selected HOA coefficient sequences, which means the rendering to $O_{MIN}$ virtual loudspeaker signals. The respective virtual loudspeaker positions are expressed by means of a spherical coordinate system shown in FIG. 6, where each position is assumed to lie on the unit sphere, i.e. to have a radius of 1. Hence, the positions can be equivalently expressed by directions $\Omega_j=(\theta_j, \phi_j)$ with $1 \leq j \leq O_{MIN}$, where $\theta_j$ and $\theta_j$ denote the inclinations and azimuths, respectively (see further below for the definition of the spherical coordinate system). These directions should be distributed on the unit sphere as uniformly as possible (see e.g. [2] on the computation of specific directions). Note that, since HOA in general defines directions in dependence of $N_{MIN}$, actually $\Omega_j^{(N_{MIN})}$ is meant where $\Omega_j$ is written herein.

In the following, the frame of all virtual loudspeaker signals is denoted by $$W(k) = \begin{bmatrix} w_1(k) \\ w_2(k) \\ \vdots \\ w_{O_{MIN}}(k) \end{bmatrix} \tag{5}$$

where $w_j(k)$ denotes the k-th frame of the j-th virtual loudspeaker signal. Further, $\psi_{MIN}$ denotes the mode matrix with respect to the virtual directions $\Omega_j$, with $1 \leq j \leq O_{MIN}$. The mode matrix is defined by $$\psi_{MIN} := [S_{MIN,1} \ldots S_{MIN,O_{MIN}}] \in \mathbb{R}^{O_{MIN} \times O_{MIN}} \tag{4}$$

with $$S_{MIN,i} := [S_0^0(\Omega_i)\ S_1^{-1}(\Omega_i)\ S_1^0(\Omega_i)\ S_1^1(\Omega_i) \ldots S_N^{N-1}(\Omega_i)\ S_N^N(\Omega_i)] \in \mathbb{R}^{O_{MIN}} \tag{7}$$

indicating the mode vector with respect to the virtual direction $\Omega_i$. Each of its elements $S_n^m(\bullet)$ denotes the real valued Spherical Harmonics function defined below (see eq.(48)). Using this notation, the rendering process can be formulated by the matrix multiplication $$W(k) = (\Psi_{MIN})^{-1} \cdot \begin{bmatrix} c_1(k) \\ \vdots \\ c_{O_{MIN}}(k) \end{bmatrix} \tag{8}$$

The signals of the intermediate representation $C_1(k)$, which is output of the partial de-correlation 12, are hence given by $$c_{I,n}(k) = \begin{cases} w_n(k) & \text{if } 1 \leq n \leq O_{MIN} \\ c_{T,n}(k) & O_{MIN}+1 \leq n \leq O \end{cases} \tag{9}$$

Channel Assignment

After having computed the frame of the intermediate representation $C_1(k)$, its individual signals $c_{I,n}(k)$ with $n \in \mathcal{I}_{C\ ACT}(k)$ are assigned 13 to the available I channels, to provide the transport signals $y_i(k)$, i=1, . . . , I, for perceptual encoding. One purpose of the assignment 13 is to avoid discontinuities of the signals to be perceptually encoded, which might occur in a case where the selection changes between successive frames. The assignment can be expressed by $$y_i(k) = \begin{cases} c_{I,v_{A,i}(k)}(k) & \text{if } 1 \leq i \leq I - O_{MIN} \\ c_{I,i-(I-O_{MIN})}(k) & \text{if } I - O_{MIN} < i \leq I \end{cases} \tag{10}$$

Gain Control

Each of the transport signals $y_i(k)$ is finally processed by a Gain Control unit 14, where the signal gain is smoothly modified to achieve a value range that is suitable for the perceptual encoders. The gain modification requires a kind of look-ahead in order to avoid severe gain changes between successive blocks, and hence introduces a delay of one frame. For each transport signal frame $y_i(k)$, the Gain Control units 14 either receive or generate a delayed frame $y_i(k-1)$, i=1, . . . , I. The modified signal frames after the gain control are denoted by $z_i(k-1)$, i=1, . . . , I. Further, in order to be able to revert in a spatial decoder any modifications made, gain control side information is provided. The gain control side information comprises the exponents $e_i(k-1)$ and the exception flags $\beta_i(k-1)$, i=1, . . . , I. A more detailed description of the Gain Control is available e.g. in [9], Sect.C.5.2.5, or [3]. Thus, the truncated HOA version 19 comprises gain controlled signal frames $z_i(k-1)$ and gain control side information $e_i(k-1)$, $\beta_i(k-1)$, i=1, . . . , I.

Analysis Filter Banks

As mentioned above, the approximated HOA representation is composed of two portions, namely the truncated HOA version 19 and a component that is represented by directional subband signals with corresponding directions, which are predicted from the coefficient sequences of the truncated HOA representation. Hence, to compute a parametric representation of the second portion, each frame of an individual coefficient sequence of the original HOA representation $c_n(k)$, n=1, . . . , O, is first decomposed into frames of individual subband signals $\tilde{c}_n(k,f_1)$, . . . , $\tilde{c}_n(k,f_F)$. This is done in one or more Analysis Filter Banks 15. For each subband $f_j$, j=1, . . . , F, the frames of the subband signals of the individual HOA coefficient sequences may be collected into the subband HOA representation $$\tilde{C}(k, f_j) = \begin{bmatrix} \tilde{c}_1(k, f_j) \\ \tilde{c}_2(k, f_j) \\ \vdots \\ \tilde{c}_O(k, f_j) \end{bmatrix} \text{ for } j = 1, \ldots, F \tag{11}$$

The Analysis Filter Banks 15 provide the subband HOA representations to a Direction Estimation Processing block 16 and to one or more computation blocks 17 for directional subband signal computation.

In principle, any type of filters (i.e. any complex valued filter bank, e.g. QMF, FFT) may be used in the Analysis Filter Banks 15. It is not required that a successive application of an analysis and a corresponding synthesis filter bank provides the delayed identity, which would be what is known as perfect reconstruction property. Note that, in contrast to the HOA coefficient sequences $c_n(k)$, their subband representations $\tilde{c}_n(k,f_j)$ are generally complex valued. Further, the subband signals $\tilde{c}_n(k, f_j)$ are in general decimated in time, compared to the original time-domain signals. As a consequence, the number of samples in the frames $\tilde{c}_n(k, f_j)$ is usually distinctly smaller than the number of samples in the time-domain signal frames $c_n(k)$, which is L.

In one embodiment, two or more subband signals are combined into subband signal groups, in order to better adapt the processing to the properties of the human hearing system. The bandwidths of each group can be adapted e.g. to the well-known Bark scale by the number of its subband signals. That is, especially in the higher frequencies two or more groups can be combined into one. Note that in this case each subband group consists of a set of HOA coefficient sequences $\tilde{\mathcal{C}}(k, f_j)$, where the number of extracted parameters is the same as for a single subband. In one embodiment, the grouping is performed in one or more subband signal grouping units (not explicitly shown), which may be incorporated in the Analysis Filter Bank block 15.

Direction Estimation

The Direction Estimation Processing block 16 analyzes the input HOA representation and computes for each frequency subband $f_j$, j=1, . . . , F, a set $M_{DIR}(k,f_j)$ of directions of subband general plane wave functions that add a major contribution to the sound field. In this context, the term "major contribution" may for instance refer to the signal power being higher as the signal power of subband general plane waves impinging from other directions. It may also refer to a high relevance in terms of the human perception. Note that, where subband grouping is used, instead of a single subband also a subband group can be used for the computation of $\mathcal{M}_{DIR}(k, f_j)$.

During decompression, artifacts in the predicted directional subband signals might occur due to changes of the estimated directions and prediction coefficients between successive frames. In order to avoid such artifacts, the direction estimation and prediction of directional subband signals during encoding are performed on concatenated long frames. A concatenated long frame consists of a current frame and its predecessor. For decompression, the quantities estimated on these long frames are then used to perform overlap add processing with the predicted directional subband signals.

A straight forward approach for the direction estimation would be to treat each subband separately. For the direction search, in one embodiment, e.g. the technique proposed in [7] may be applied. This approach provides, for each individual subband, smooth temporal trajectories of direction estimates, and is able to capture abrupt direction changes or onsets. However, there are two disadvantages with this known approach. First, the independent direction estimation in each subband may lead to the undesired effect that, in the presence of a full-band general plane wave (e.g. a transient drum beat from a certain direction), estimation errors in the individual sub-directions may lead to subband general plane waves from different directions that do not add up to the desired full-band version from one single direction. In particular, transient signals from certain directions are blurred.

Second, considering the intention to obtain a low bit-rate compression, the total bit-rate resulting from the side information must be kept in mind. In the following, an example will show that the bit rate for such naive approach is rather high. Exemplarily, the number of subbands F is assumed to be 10, and the number of directions for each subband (which corresponds to the number of elements in each set $\mathcal{M}_{DIR}(k, f_j)$) is assumed to be 4. Further, it is assumed to perform for each subband the search on a grid of Q=900 potential direction candidates, as proposed in [9]. This requires $[\log_2(Q)]=10$ bits for the simple coding of a single direction. Assuming a frame rate of about 50 frames per second, a resulting overall data rate is $$10\frac{\text{bit}}{\text{direction}}\cdot 4\frac{\text{directions}}{\text{band}}\cdot 10\frac{\text{bands}}{\text{frame}}\cdot 50\frac{\text{frames}}{\text{s}} = 20\ \text{kbit/s}$$

just for a coded representation of the directions. Even if a frame rate of 25 frames per second is assumed, the resulting data rate of 10 kbit/s is still rather high.

Figure 2:
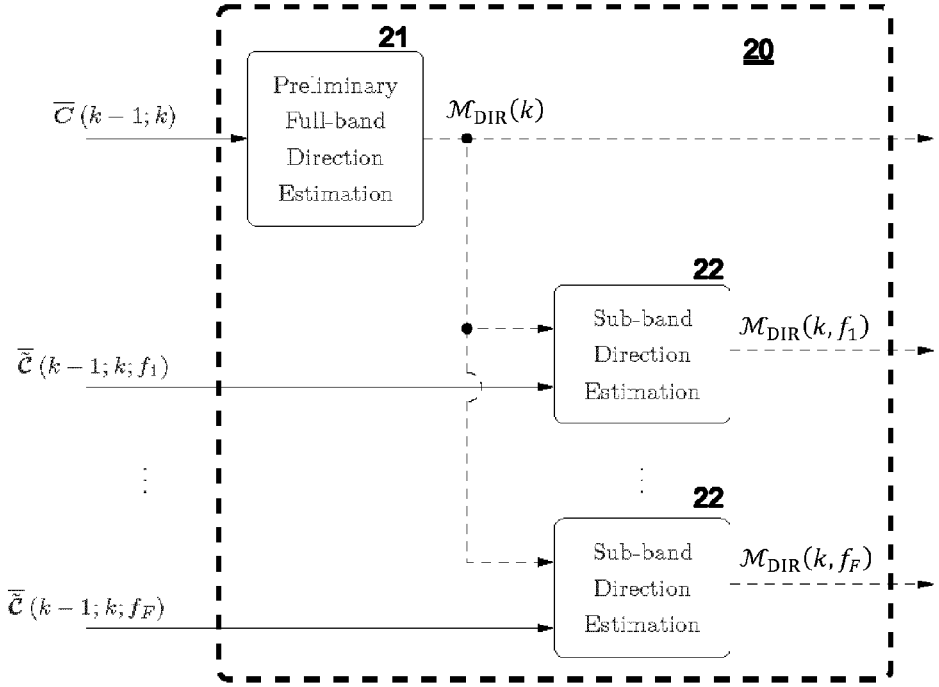

As an improvement, the following method for direction estimation is used in a Direction Estimation block 20, in one embodiment. The general idea is illustrated in FIG. 2. In a first step, a Full-band Direction Estimation block 21 performs a preliminary full-band direction estimation, or search, on a direction grid that consists of Q test directions $\Omega_{TEST,q}$, q=1, . . . , Q, using the concatenated long frame $$\overline{C}(k-1;k)=[C(k-1)\ C(k)] \tag{12}$$

where C(k) and C(k−1) are the current and previous input frames of the full-band original HOA representation. This direction search provides a number of D(k)≤D direction candidates $\Omega_{CAND,d}(k)$, d=1, . . . , D(k), which are contained in the set $M_{DIR}(k)$, i.e.

$$\mathcal{M}_{DIR}(k)=\{\Omega_{CAND,1}(k), \ldots, \Omega_{CAND,D(k)}(k)\}. \tag{13}$$

A typical value for the maximum number of direction candidates per frame is D=16. The direction estimation can be accomplished e.g. by the method proposed in [7]: the idea is to combine the information obtained from a directional power distribution of the input HOA representation with a simple source movement model for the Bayesian inference of the directions.

In a second step, a direction search is carried out for each individual subband by a Sub-band Direction Estimation block 22 per subband (or subband group). However, this direction search for subbands needs not consider the initial full direction grid consisting of Q test directions, but rather only the candidate set $\mathcal{M}_{DIR}(k)$, comprising only D(k) directions for each subband. The number of directions for the $f_j$-th subband, j=1, . . . , F, denoted by $D_{SB}(k, f_j)$, is not greater than $D_{SB}$, which is typically distinctly smaller than D, e.g. $D_{SB}=4$. Like the full-band direction search, the subband related direction search is also performed on long concatenated frames of subband signals $$\hat{\tilde{\mathcal{C}}}(k-1;k;f_j)=[\tilde{\mathcal{C}}(k-1,f_j)\ \tilde{\mathcal{C}}(k,f_j)]j=1, \ldots, F \tag{14}$$

consisting of the previous and current frame. In principle, the same Bayesian inference methods as for the full-band related direction search may be applied for the subband related direction search.

The direction of a particular sound source may (but needs not) change over time. A temporal sequence of directions of a particular sound source is called "trajectory" herein. Each subband related direction, or trajectory respectively, gets an unambiguous index, which prevents mixing up different trajectories and provides continuous directional sub-band signals. This is important for the below-described prediction of directional subband signals. In particular, it allows exploiting temporal dependencies between successive prediction coefficient matrices $A(k, f_j)$ defined further below. Therefore, the direction estimation for the $f_j$-th subband provides the set $\mathcal{M}_{DIR}(k,f_j)$ of tuples. Each tuple consists of, on the one hand, the index $d \in \mathcal{J}_{DIR}(k, f_j) \subseteq \{1, \ldots, D_{SB}\}$ identifying an individual (active) direction trajectory, and on the other hand, the respective estimated direction $\Omega_{SB,d}(k,f_j)$, i.e.

$$\mathcal{M}_{DIR}(k,f_j)=\{(d,\Omega_{SB,d}(k,f_j))|d\in\mathcal{J}_{DIR}(k,f_j)\}. \tag{15}$$

By definition, the set $\{\Omega_{SB,d}(k,f_j)|d \in J_{DIR}(k,f_j)\}$ is a subset of $\mathcal{M}_{DIR}(k)$ for each j=1, . . . , F, since the subband direction search is performed only among the current frame's direction candidates $\Omega_{CAND,d}(k)$, d=1, . . . , D(k), as mentioned above. This allows a more efficient coding of the side information with respect to the directions, since each index defines one direction out of D(k) instead of Q candidate directions, with $D(k) \leq Q$. The index d is used for tracking directions in a subsequent frame for creating a trajectory.

As shown in FIG. 2 and described above, a Direction Estimation Processing block 16 in one embodiment comprises a Direction Estimation block 20 having a Full-band Direction Estimation block 21 and, for each subband or subband group, a Subband Direction Estimation block 22. It may further comprise a Long Frame Generating block 23 that provides the above-mentioned long frames to the Direction Estimation block 20, as shown in FIG. 7. The Long Frame Generating block 23 generates long frames from two successive input frames having a length of L samples each, using e.g. one or more memories. Long frames are herein indicated by "-" and by having two indices, k−1 and k. In other embodiments, the Long Frame Generating block 23 may also be a separate block in the encoder shown in FIG. 1, or incorporated in other blocks.

Computation of Directional Subband Signals

Returning to FIG. 1, subband HOA representation frames $\tilde{\mathbf{c}}(k, f_j)$, j=1, . . . , F, provided by the Analysis Filter Bank 15 are also input to one or more Directional Subband Signal Computation blocks 17. In the Directional Subband Signal Computation blocks 17, the long frames of all $D_{SB}$ potential directional subband signals $\bar{\tilde{x}}_d(k-1; k; f_j)$, d=1, . . . , $D_{SB}$, are arranged in a matrix $\bar{\tilde{X}}(k-1; k; f_j)$ as $$\bar{\tilde{X}}(k-1;k;f_j)=\begin{bmatrix}\bar{\tilde{x}}_1(k-1;k;f_j)\\ \bar{\tilde{x}}_2(k-1;k;f_j)\\ \vdots\\ \bar{\tilde{x}}_{D_{SB}}(k-1;k;f_j)\end{bmatrix}\in\mathbb{C}^{D_{SB}\times 2L}. \tag{16}$$

Further, the frames of the inactive directional subband signals, i.e. those long signal frames $\bar{\tilde{x}}_d(k-1; k; f_j)$ whose index d is not contained within the set $J_{DIR}(k, f_j)$, are set to zero.

The remaining long signal frames $\bar{\tilde{x}}_d(k-1; k; f_j)$, i.e. those with index $d \in \mathcal{J}_{DIR}(k, f_j)$, are collected within the matrix $\bar{\tilde{x}}_{ACT}(k-1; k; f_j) \in \mathbb{C}^{D_{SB}(k,f_j)\times 2L}$. One possibility to compute the active directional subband signals contained therein is to minimize the error between their HOA representation and the original input subband HOA representation. The solution is given by $$\bar{\tilde{x}}_{ACT}(k-1;k;f_j)=(\psi_{SB}(k,f_j))^{+}\bar{\tilde{C}}(k-1;k;f_j) \tag{17}$$

where $(\bullet)^{+}$ denotes the Moore-Penrose pseudo-inverse and $\psi_{SB}(k, f_j) \in \mathbb{R}^{O\times D_{SB}(k,f_j)}$ denotes the mode matrix with respect to the direction estimates in the set $\{\Omega_{SB,d}(k, f_j)|d \in \mathcal{J}_{DIR}(k, f_j)\}$. Note that in the case of subband groups a set of directional subband signals $\bar{\tilde{x}}_{ACT}(k-1; k; f_j)$ is computed from the multiplication of one matrix $(\psi_{SB}(k, f_j))^{+}$ by all HOA representations $\bar{\tilde{\mathbf{c}}}(k-1; k; f_j)$ of the group. Note that long frames can be generated by one or more further Long Frame Generating blocks, similar to the one described above. Similarly, long frame can be decomposed into frames of normal length in Long Frame Decomposition blocks. In one embodiment, the blocks 17 for the computation of directional subbands provide on their outputs long frames $\bar{\tilde{x}}_{ACT}(k-1;k; f_j)$, j=1, . . . , F, towards the Directional Subband Prediction blocks 18.

Prediction of Directional Subband Signals

As mentioned above, the approximate HOA representation is partly represented by the active directional subband signals, which, however, are not conventionally coded. Instead, in the presently described embodiments a parametric representation is used in order to keep the total data rate for the transmission of the coded representation low. In the parametric representation, each active directional subband signal $\bar{\tilde{x}}_d(k-1; k; f_j)$, i.e. with index $d \in \mathcal{J}_{DIR}(k, f_j)$, is predicted by a weighted sum of the coefficient sequences of the truncated subband HOA representation $\tilde{c}_n(k-1, f_j)$ and $\tilde{c}_n(k, f_j)$, where $n \in \mathcal{J}_{C,ACT}(k-1)$ and where the weights are complex valued in general.

Hence, assuming $\bar{\tilde{x}}_P(k-1; k; f_j)$ to represent the predicted version of $\bar{\tilde{x}}(k-1; k; f_j)$, the prediction is expressed by a matrix multiplication as $$\bar{\tilde{x}}_P(k-1;k;f_j)=A(k,f_j)\ \bar{\tilde{\mathbf{c}}}_T(k-1;k;f_j), \tag{18}$$

where $A(k, f_j) \in \mathbb{C}^{O\times D_{SB}}$ is the matrix with all weighting factors (or, equivalently, prediction coefficients) for the subband $f_j$. The computation of the prediction matrices $A(k, f_j)$ is performed in one or more Directional Subband Prediction blocks 18. In one embodiment, one Directional Subband Prediction block 18 per subband is used, as shown in FIG. 1. In another embodiment, a single Directional Subband Prediction block 18 is used for multiple or all subbands. In the case of subband groups, one matrix $A(k, f_j)$ is computed for each group; however, it is multiplied by each HOA representations $\bar{\tilde{\mathbf{c}}}_T(k-1; k; f_j)$ of the group individually, creating a set of matrices $\bar{\tilde{x}}_P(k-1; k; f_j)$ per group. Note that per construction all rows of $A(k, f_j)$ except for those with index $d \in \mathcal{J}_{DIR}(k, f_j)$ are zero. This means that only the active directional subband signals are predicted. Further, all columns of $A(k, f_j)$ except for those with index $n \in \mathcal{J}_{C,ACT}(k-1)$ are also zero. This means that, for the prediction, only those HOA coefficient sequences are considered that are transmitted and available for prediction during HOA decompression.

The following aspects have to be considered for the computation of the prediction matrices $A(k,f_j)$.

First, the original truncated subband HOA representation $\tilde{\mathbf{c}}_T(k,f_j)$ will generally not be available at the HOA decompression. Instead, a perceptually decoded version $\hat{\tilde{\mathbf{c}}}_T(k, f_j)$ of it will be available and used for the prediction of the directional subband signals. At low bit rates, typical audio codecs (like AAC or USAC) use spectral band replication (SBR), where the lower and mid frequencies of the spectrum are conventionally coded, while the higher frequency content (starting e.g. at 5 kHz) is replicated from the lower and mid frequencies using extra side information about the high-frequency envelope. For that reason, the magnitude of the reconstructed subband coefficient sequences of the truncated HOA component $\hat{\tilde{\mathbf{c}}}_T(k, f_j)$ after perceptual decoding resembles that of the original one, $\tilde{\mathbf{c}}_T(k, f_j)$. However, this is not the case for the phase. Hence, for the high frequency subbands it does not make sense to exploit any phase relationships for the prediction by using complex valued prediction coefficients. Instead, it is more reasonable to use only real valued prediction coefficients. In particular, defining the index $j_{SBR}$ such that the $f_j$-th subband includes the starting frequency for SBR, it is advantageous to set the type of prediction coefficients as follows:

$$A(k, f_j) \in \begin{cases} \mathbb{C}^{O\times D_{SB}} & \text{for } 1 \le j < j_{SBR} \\ \mathbb{R}^{O\times D_{SB}} & \text{for } j_{SBR} \le j \le F \end{cases}. \tag{19}$$

In other words, in one embodiment, prediction coefficients for the lower subbands are complex values, while prediction coefficients for higher subbands are real values.

Second, in one embodiment, the strategy of the computation of the matrices $A(k, f_j)$ is adapted to their types. In particular, for low frequency subbands $f_j$, $1 \le j < j_{SBR}$, which are not affected by the SBR, it is possible to determine the non-zero elements of $A(k, f_j)$ by minimizing the Euclidean norm of the error between $\tilde{\bar{x}}(k-1; k; f_j)$ and its predicted version $\tilde{\bar{x}}_P(k-1; k; f_j)$. The perceptual coder 31 defines and provides $j_{SBR}$ (not shown). In this way, phase relationships of the involved signals are explicitly exploited for prediction. For subband groups, the Euclidean norm of the prediction error over all directional signals of the group should be minimized (i.e. least square prediction error). For high frequency subbands $f_j$, $j_{SBR} \le j \le F$, which are affected by SBR, the above mentioned criterion is not reasonable, since the phases of the reconstructed subband coefficient sequences of the truncated HOA component $\hat{\tilde{\mathbf{c}}}_T(k, f_j)$ cannot be assumed to even rudimentary resemble that of the original subband coefficient sequences.

In this case, one solution is to disregard the phases and, instead, concentrate only on the signal powers for prediction. A reasonable criterion for the determination of the prediction coefficients is to minimize the following error $$|\tilde{\bar{x}}(k-1;k;f_j)|^2 - |A(k,f_j)|^2 |\, \tilde{\bar{\mathbf{c}}}_T(k-1;k;f_j)|^2 \tag{20}$$

where the operation $|\bullet|^2$ is assumed to be applied to the matrices element-wise. In other words, the prediction coefficients are chosen such that the sum of the powers of all weighted subband or subband group coefficient sequences of the truncated HOA component best approximates the power of the directional subband signals. In this case, Nonnegative Matrix Factorization (NMF) techniques (see e.g. [8]) can be used to solve this optimization problem and obtain the prediction coefficients of the prediction matrices $A(k, f_j)$, $j=1, \ldots, F$. These matrices are then provided to the Perceptual and Source Encoding stage 30.

Perceptual and Source Encoding

After the above-described spatial HOA coding, the resulting gain adapted transport signals for the (k−1)-th frame, $z_i(k-1)$, $i=1, \ldots, I$, are coded to obtain their coded representations $\check{z}_i(k-1)$. This is performed by a Perceptual Coder 31 at the Perceptual and Source Encoding stage 30 shown in FIG. 3. Further, the information contained in the sets $\mathcal{M}_{DIR}(k)$, $\mathcal{M}_{DIR}(k, f_j)$, $j=1, \ldots, F$, the prediction coefficients matrices $A(k, f_j) \in C^{O\times D_{SB}}$, $j=1, \ldots, F$, the gain control parameters $e_i(k-1)$ and $\beta_i(k-1)$, $i=1, \ldots, I$, and the assignment vector $v_A(k-1)$ are subjected to source encoding to remove redundancy for an efficient storage or transmission. This is performed in a Side Information Source Coder 32. The resulting coded representation $\check{\Gamma}(k-1)$ is multiplexed in a multiplexer 33 together with the coded transport signal representations $\check{\mathbf{z}}_i(k-1)$, $i=1, \ldots, I$, to provide the final coded frame $\check{\mathbf{B}}(k-1)$.

Since, in principle, the source coding of the gain control parameters and the assignment can be carried out similar to [9], the present description concentrates on the coding of the directions and prediction parameters only, which is described in detail in the following.

Coding of Directions

For the coding of the individual subband directions, the irrelevancy reduction according to the above description can be exploited to constrain the individual subband directions to be chosen. As already mentioned, these individual subband directions are chosen not out of all possible test directions $\Omega_{TEST,q}$, $q=1, \ldots, Q$, but rather out of a small number of candidates determined on each frame of the full-band HOA representation. Exemplarily, a possible way for the source coding of the subband directions is summarized in the following Algorithm 1.

Algorithm 1 Coding of sub-band directions

```
NoOfGlobalDirs (k) ( coded with ⌈log2 (D)⌉ bits )
{Fill GlobalDirGridIndices (k) ( array with NoOfGlobalDirs (k) elements, each coded with ⌈log2 (Q)⌉ bits) }
  for d = 1 to NoOfGlobalDirs (k) do
    GlobalDirGridIndices (k) [d] = q such that Ω_FB,d (k) = Ω_TEST,q          // global directions
  end for
for j = 1 to F do
  {Fill bSubBandDirIsActive (k, f_j) ( bit array with D_SB elements) }
    for d = 1 to D_SB do
      if d ∈ I_DIR (k, f_j) then                                              // active directions
        bSubBandDirIsActive (k, f_j) [d] = 1                                  // per subband
      else
        bSubBandDirIsActive (k, f_j) [d] = 0
      end if
    end for
  {Fill RelDirIndices (k, f_j)
  (array with D_SB (k, f_j) elements, each coded with ⌈log2 (NoOfGlobalDirs (k))⌉ bits ) }
    for d = 1 to D_SB do                                                      // direction index of
      d1 = 1                                                                  // full band
      if bSubBandDirIsActive (k, f_j) [d] = 1 then
```

-continued

Algorithm 1 Coding of sub-band directions

```
        RelDirIndices (k, f_j) [d_1] = i such that Ω_{SB,d} (k, f_j) = Ω_{FB,i} (k)
        d_1 = d_1 + 1
      end if
    end for
end for
```

In a first step of the Algorithm 1, the set $\mathcal{M}_{FB}(k)$ of all full-band direction candidates that do actually occur as subband directions is determined, i.e.

$$\mathcal{M}_{FB}(k) := \left\{ \begin{array}{c} \Omega_{CAND,d}(k) \mid \exists\, j \in \{1, \ldots, F\} \text{ and } d \in \mathcal{J}_{DIR}(k, f_j) \\ \text{such that } \Omega_{CAND,d}(k) = \Omega_{SB,d}(k, f_j) \end{array} \right\} \tag{21}$$

The number of elements of this set, denoted by NoOfGlobalDirs(k), is the first part of the coded representation of the directions. Since $\mathcal{M}_{FB}(k)$ is a subset of $\mathcal{M}_{DIR}(k)$ by definition, NoOfGlobalDirs(k) can be coded with $[\log_2(D)]$ bits. To clarify the further description, the directions in the set $\mathcal{M}_{FB}(k)$ are denoted by $\Omega_{FB,d}(k)$, d=1, . . . , NoOfGlobalDirs(k), i.e.

$$\mathcal{M}_{FB}(k) := \{\Omega_{FB,d}(k) \mid d=1, \ldots, \text{NoOfGlobalDirs}(k)\} \tag{22}$$

In a second step, the directions in the set $\mathcal{M}_{FB}(k)$ are coded by means of the indices q=1, . . . , Q of possible test directions $\Omega_{TEST,q}$, here referred to as grid. For each direction $\Omega_{FB,d}(k)$, d=1, . . . , NoOfGlobalDirs(k), the respective grid index is coded in the array element GlobalDirGridIndices(k)[d] having a size of $[\log_2(Q)]$ bits. The total array GlobalDirGridIndices(k) representing all coded full-band directions consists of NoOfGlobalDirs(k) elements.

In a third step, for each subband or subband group $f_j$, j=1, . . . , F, the information whether the d-th directional subband signal (d=1, . . . , $D_{SB}$) is active or not, i.e. if $d \in \mathcal{J}_{DIR}(k, f_j)$, is coded in the array element bSubBandDirIsActive(k,$f_j$)[d]. The total array bSubBandDirIsActive(k,$f_j$) consists of $D_{SB}$ elements. If $d \in \mathcal{J}_{DIR}(k,f_j)$, the respective subband direction $\Omega_{SB,d}(k,d_j)$ is coded by means of the index i of the respective full-band direction $\Omega_{FB,i}(k)$ into the array RelDirIndices(k,$f_j$) consisting of $D_{SB}(k, f_j)$ elements.

To show the efficiency of this direction encoding method, a maximum data rate for the coded representation of the directions according to the above example is calculated: F=10 subbands, $D_{SB}(k,f_j)=D_{SB}=4$ directions per subband, Q=900 potential test directions and a frame rate of 25 frames per second are assumed. With the conventional coding method, the required data rate was 10 kbit/s. With the improved coding method according to one embodiment, if the number of full-band directions is assumed to be NoOfGlobalDirs(k)=D=8, then $D\cdot[\log_2(Q)]=80$ bits are needed per frame to code GlobalDirGridIndices(k), $D_{SB}\cdot F=40$ bits to code bSubBandDirIsActive(k,$f_j$), and $D_{SB}\cdot F\cdot[\log_2(\text{NoOfGlobalDirs}(k))]=120$ bits to code RelDirIndices(k,$f_j$). This results in a data rate of 240 bits/frame·25 frames/s=6 kbit/s, which is distinctly smaller than 10 kbit/s. Even for a greater number NoOfGlobalDirs(k)=D=16 of full-band directions, a data rate of only 7 kbit/s is sufficient.

Coding of Prediction Coefficient Matrices

For the coding of the prediction coefficient matrices, the fact can be exploited that there is a high correlation between the prediction coefficients of successive frames due to the smoothness of the direction trajectories and consequently the directional subband signals. Further, there is a relatively high number of $(D_{SB}(k,f_j)\cdot M_{C,ACT}(k-1))$ potential non-zero-elements per frame for each prediction coefficient matrix A(k,$f_j$), where $M_{C,ACT}(k-1)$ denotes the number of elements in the set $\mathcal{J}_{C,ACT}(k-1)$. In total, there are F matrices to be coded per frame if no subband groups are used. If subband groups are used, there are correspondingly less than F matrices to be coded per frame. In one embodiment, in order to keep the number of bits for each prediction coefficient low, each complex valued prediction coefficient is represented by its magnitude and its angle, and then the angle and the magnitude are coded differentially between successive frames and independently for each particular element of the matrix A(k,$f_j$). If the magnitude is assumed to be within the interval [0,1], the magnitude difference lies within the interval [−1,1]. The difference of angles of complex numbers may be assumed to lie within the interval $[-\pi, \pi]$. For the quantization of both, magnitude and angle difference, the respective intervals can be subdivided into e.g. $2^{N_Q}$ subintervals of equal size. A straight forward coding then requires $N_Q$ bits for each magnitude and angle difference. Further, it has been found out experimentally that due to the above mentioned correlation between the prediction coefficients of successive frames, the occurrence probabilities of the individual differences are highly non-uniformly distributed. In particular, small differences in the magnitudes as well as in the angles occur significantly more frequently than bigger ones. Hence, a coding method that is based on the a priori probabilities of the individual values to be coded, like e.g. Huffman coding, can be exploited to reduce the average number of bits per prediction coefficient significantly. In other words, it has been found that it is usually advantageous to differentially encode magnitude and phase of the values in the prediction matrix A(k,$f_j$), instead of their real and imaginary portions. However, there may appear circumstances under which the usage of real and imaginary portions is acceptable.

In one embodiment, special access frames are sent in certain intervals (application specific, e.g. once per second) that include the non-differentially coded matrix coefficients. This allows a decoder to re-start a differential decoding from these special access frames, and thus enables a random entry for the decoding.

In the following, decompression of a low bit rate compressed HOA representation as constructed above is described. Also the decompression works frame-wise. In principle, a low bit rate HOA decoder, according to an embodiment, comprises counterparts of the above-described low bit rate HOA encoder components, which are arranged in reverse order. In particular, the low bit rate HOA decoder can be subdivided into a perceptual and source decoding part as depicted in FIG. 4, and a spatial HOA decoding part as illustrated in FIG. 6.

Perceptual and Source Decoding

Figure 4:
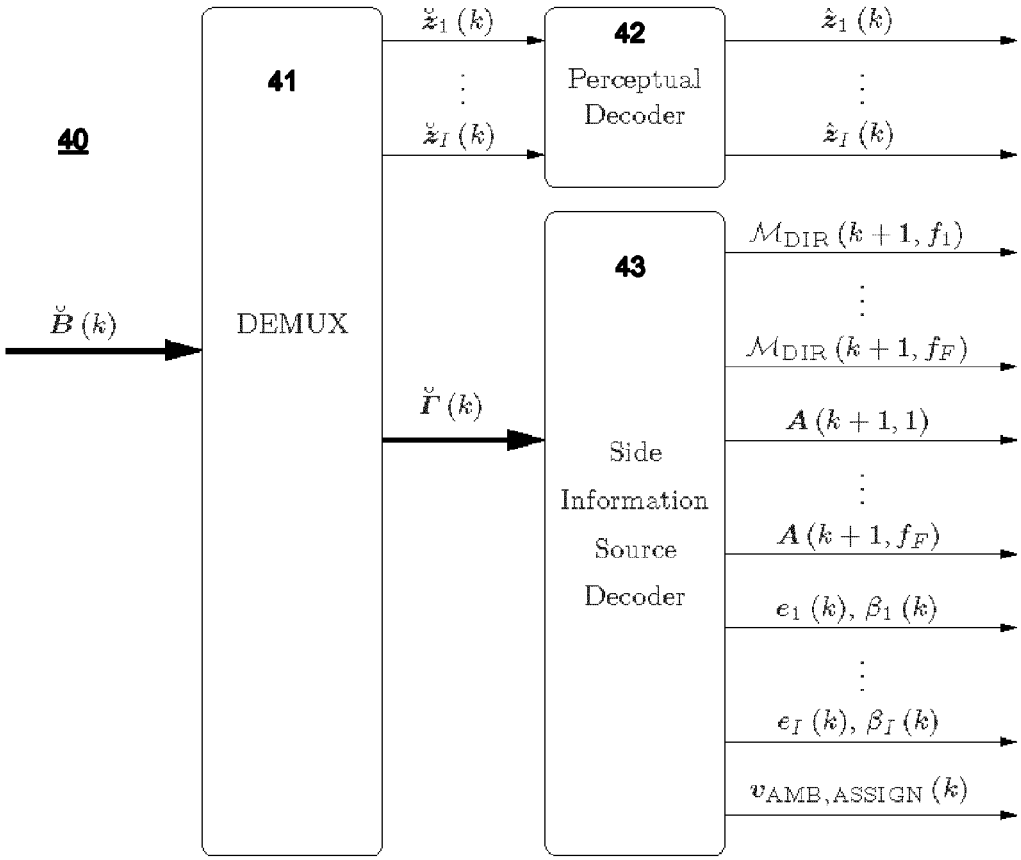

FIG. 4 shows a Perceptual and Side Info Source Decoder 40, in one embodiment. In the Perceptual and Side Info Source Decoder 40, the low bit rate compressed HOA bit stream $\breve{B}$ is first de-multiplexed 41, which results in a perceptually coded representation of the I signals $\breve{z}_i$, i=1, . . . , I, and the coded side information $\breve{\Gamma}$ describing how to create a HOA representation thereof. Successively, a perceptual decoding of the I signals and a decoding of the side information is performed.

A Perceptual Decoder 42 decodes the I signals $\breve{z}_i(k)$, i=1, . . . , I into the perceptually decoded signals $\hat{z}_i(k)$, i=1, . . . , I.

A Side Information Source decoder 43 decodes the coded side information $\breve{\Gamma}$ into the tuple sets $\mathcal{M}_{DIR}(k+1, f_j)$, j=1, . . . , F, the prediction coefficient matrices $A(k+1, f_j)$ for each subband or subband group $f_j$ (j=1, . . . , F), gain correction exponents $e_i(k)$ and gain correction exception flags $\beta_i(k)$, and assignment vector $v_{AMB,ASSIGN}(k)$.

Algorithm 2 summarizes exemplarily how to create the tuple sets $\mathcal{M}_{DIR}(k,f_j)$, j=1, . . . , F, from the coded side information $\breve{\Gamma}$. The decoding of the subband directions is described in detail in the following.

Algorithm 2 Decoding of sub-band directions

```
Read NoOfGlobalDirs (k) ( coded with ⌈log2 (D)⌉ bits )
{Read GlobalDirGridIndices (k) ( array with NoOfGlobalDirs (k) elements, each coded by
⌈log2 (Q)⌉ bits) }
{Compute M_FB (k) }
  for d = 1 to NoOfGlobalDirs (k) do
    Ω_FB,d (k) = Ω_TEST,GlobalDirGridIndices(k)[d]
  end for
for j = 1 to F do
  {Read bSubBandDirIsActive (k, f_j) ( bit array with D_SB dements) }
  {Compute D_SB (k, f_j) }
    D_SB (k, f_j) = 0
    for d = 1 to D_SB (k, f_j) do
      if bSubBandDirIsActive (k, f_j) [d] = 1 then
        D_SB (k, f_j) = D_SB (k, f_j) + 1
      end if
    end for
  {Read RelDirIndices (k, f_j) (array with D_SB (k, f_j) elements, each coded with ⌈log2 (NoOfGlobalDirs
(k))⌉
bits) }
  {Compute M_DIR (k, f_j) }
    for d = 1 to D_SB (k, f_j) do
      d_1 = 1
      if bSubBandDirIsActive (k, f_j) [d] = 1 then
        Ω_SB,d (k, f_j) = Ω_FB,RelDirIndices(k,f_j)[d_1] (k)
        M_DIR (k, f_j) = M_DIR (k, f_j) ∪ {d, Ω_SB,d (k, f_j)}
        d_1 = d_1 + 1
      end if
    end for
end for
```

First, the number of full-band directions NoOfGlobalDirs (k) is extracted from the coded side information $\breve{\Gamma}$. As described above, these are also used as subband directions. It is coded with $[\log_2(D)]$ bits.

In a second step, the array GlobalDirGridIndices(k) consisting of NoOfGlobalDirs(k) elements is extracted, each element being coded by $[\log_2(Q)]$ bits. This array contains the grid indices that represent the full-band directions $\Omega_{FB,d}(k)$, d=1, . . . , NoOfGlobalDirs(k), such that $$\Omega_{FB,d}(k)=\Omega_{TEST,GlobalDirGridIndices(k)[d]} \tag{23}$$

Then, for each subband or subband group $f_j$, j=1, . . . , F, the array bSubBandDirIsActive(k, $f_j$) consisting of $D_{SB}$ elements is extracted, where the d-th element bSubBandDirIsActive(k,$f_j$)[d] indicates whether or not the d-th subband direction is active. Further, the total number of active subband directions $D_{SB}(k, f_j)$ is computed. Finally, the set $\mathcal{M}_{DIR}(k,f_j)$ of tuples is computed for each subband or subband group $f_j$, j=1, . . . , F. It consists of the indices $d \in \mathcal{J}_{DIR}(k, f_j) \subseteq \{1, D_{SB}\}$ that identify the individual (active) subband direction trajectories, and the respective estimated directions $\Omega_{SB,d}(k, f_j)$.

Next, the prediction coefficient matrices $A(k+1, f_j)$ for each subband or subband group $f_j$, j=1, . . . , F are reconstructed from the coded frame $\breve{B}(k)$. In one embodiment, the reconstruction comprises the following steps per subband or subband group $f_j$: First, the angle and magnitude differences of each matrix coefficient are obtained by entropy decoding. Then, the entropy decoded angle and magnitude differences are rescaled to their actual value ranges, according to the number of bits $N_Q$ used for their coding. Finally, the current prediction coefficient matrix $A(k+1, f_j)$ is built by adding the reconstructed angle and magnitude differences to the coefficients of the latest coefficient matrix $A(k, f_j)$, i.e. the coefficient matrix of the previous frame.

Thus, the previous matrix $A(k, f_j)$ has to be known for the decoding of a current matrix $A(k+1, f_j)$. In one embodiment, in order to enable a random access, special access frames are received in certain intervals that include the non-differentially coded matrix coefficients to re-start the differential decoding from these frames.

Figure 5:
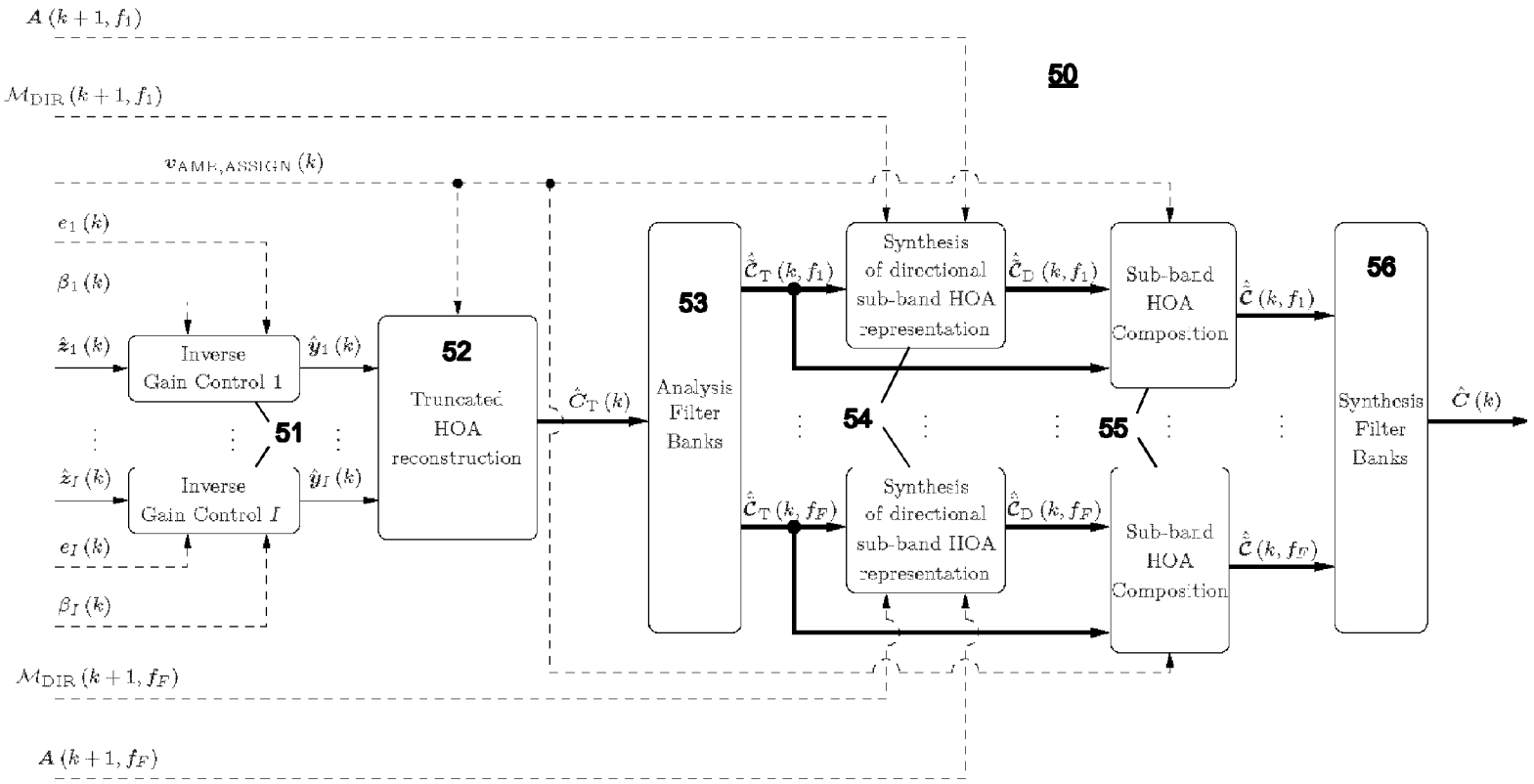

The Perceptual and Side Info Source Decoder 40 outputs the perceptually decoded signals $\hat{z}_i(k)$, i=1, . . . , I, tuple sets $M_{DIR}(k+1, f_j)$, j=1, . . . , F, prediction coefficient matrices $A(k+1, f_j)$, gain correction exponents $e_i(k)$, gain correction exception flags $\beta_i(k)$ and assignment vector $v_{AMB,ASSIGN}(k)$ to a subsequent Spatial HOA decoder 50. Spatial HOA decoding FIG. 5 shows an exemplary Spatial HOA decoder 50, in one embodiment. The spatial HOA decoder 50 creates from the I signals $\hat{z}_i(k)$, i=1, . . . , I, and the above-described side information provided by the Side Information Decoder 43 a reconstructed HOA representation. The individual processing units within the spatial HOA decoder 50 are described in detail in the following.

Inverse Gain Control

In the Spatial HOA decoder 50, the perceptually decoded signals $\hat{z}_i(k)$, i=1, . . . , I, together with the associated gain correction exponent $e_i(k)$ and gain correction exception flag $\beta_i(k)$, are first input to one or more Inverse Gain Control processing blocks 51. The Inverse Gain Control processing blocks provide gain corrected signal frames $\hat{y}_i(k)$, i=1, . . . , I. In one embodiment, each of the I signals $\hat{z}_i(k)$ is fed into a separate Inverse Gain Control processing block 51, as in FIG. 5, so that the i-th Inverse Gain Control processing block provides a gain corrected signal frame $\hat{y}_i(k)$. A more detailed description of the Inverse Gain Control is known from e.g. [9], Section 11.4.2.1.

Truncated HOA Reconstruction

In a Truncated HOA Reconstruction block 52, the I gain corrected signal frames $\hat{y}_i(k)$, i=1, . . . , I, are redistributed (i.e. reassigned) to a HOA coefficient sequence matrix, according to the information provided by the assignment vector $v_{AMB,ASSIGN}(k)$, so that the truncated HOA representation $\hat{C}_T(k)$ is reconstructed. The assignment vector $v_{AMB,ASSIGN}(k)$ comprises I components that indicate for each transmission channel which coefficient sequence of the original HOA component it contains. Further, the elements of the assignment vector form a set $J_{C,ACT}(k)$ of the indices, referring to the original HOA component, of all the received coefficient sequences for the k-th frame $$\mathcal{J}_{C,ACT}(k)=\{v_{AMB,ASSIGN,i}(k)|i=1, \ldots ,I\}. \tag{24}$$

The reconstruction of the truncated HOA representation $\hat{C}_T(k)$ comprises the following steps:

First, the individual components $\hat{c}_{I,n}(k)$, n=1, . . . , O, of the decoded intermediate representation $$\hat{C}_I(k) = \begin{bmatrix} \hat{c}_{I,1}(k) \\ \vdots \\ \hat{c}_{I,O}(k) \end{bmatrix} \tag{25}$$

are either set to zero or replaced by a corresponding component of the gain corrected signal frames $\hat{y}_i(k)$, depending on the information in the assignment vector, i.e.

$$\hat{c}_{I,n}(k) = \begin{cases} \hat{y}_i(k) & \text{if } \exists\, i \in \{1, \ldots , I\} \text{ such that } v_{AMB,ASSIGN,i}(k) = n \\ 0 & \text{else} \end{cases} \tag{26}$$

This means, as mentioned above, that the i-th element of the assignment vector, which is n in eq.(26), indicates that the i-th coefficient $\hat{y}_i(k)$ replaces $\hat{c}_{I,n}(k)$ in the n-th line of the decoded intermediate representation matrix $\hat{C}_I(k)$.

Second, a re-correlation of the first $O_{MIN}$ signals within $\hat{C}_I(k)$ is carried out by applying to them the inverse spatial transform, providing the frame $$\hat{C}_{T,MIN}(k) = \Psi_{MIN} \begin{bmatrix} \hat{c}_{I,1}(k) \\ \hat{c}_{I,2}(k) \\ \vdots \\ \hat{c}_{I,O_{MIN}}(k) \end{bmatrix} \tag{27}$$

where the mode matrix $\psi_{MIN}$ is as defined in eq.(6). The mode matrix depends on given directions that are predefined for each $O_{MIN}$ or $N_{MIN}$ respectively, and can thus be constructed independently both at the encoder and decoder. Also $O_{MIN}$ (or $N_{MIN}$) is predefined by convention.

Finally, the reconstructed truncated HOA representation $\hat{C}_T(k)$ is composed from the re-correlated signals $\hat{C}_{T,MIN}(k)$ and the signals of the intermediate representation $\hat{c}_{I,n}(k)$, n=$O_{MIN}$+1, . . . , O, according to $$\hat{C}_T(k) = \begin{bmatrix} \hat{C}_{T,MIN}(k) \\ \hat{c}_{I,O_{MIN}+1}(k) \\ \vdots \\ \hat{c}_{I,O}(k) \end{bmatrix} \in \mathbb{R}^{O\times L}. \tag{28}$$

Analysis Filter Banks

To further compute the second HOA component, which is represented by predicted directional subband signals, each frame $\hat{c}_{T,n}(k)$, n=1, . . . , O, of an individual coefficient sequence n of the decompressed truncated HOA representation $\hat{C}_T(k)$ is first decomposed in one or more Analysis Filter Banks 53 into frames of individual subband signals $\tilde{\hat{c}}_{T,n}(k,f_j)$, j=1, . . . , F. For each subband $f_j$, j=1, . . . , F, the frames of the sub-band signals of the individual HOA coefficient sequences may be collected into the sub-band HOA representation $\hat{\tilde{\boldsymbol{c}}}_T(k, f_j)$ as $$\hat{\tilde{C}}_T(k, f_j) = \begin{bmatrix} \hat{\tilde{c}}_{T,1}(k, f_j) \\ \hat{\tilde{c}}_{T,2}(k, f_j) \\ \vdots \\ \hat{\tilde{c}}_{T,O}(k, f_j) \end{bmatrix} \text{ for } j = 1, \ldots , F \tag{29}$$

The one or more Analysis Filter Banks 53 applied at the HOA spatial decoding stage are the same as those one or more Analysis Filter Banks 15 at the HOA spatial encoding stage, and for subband groups the grouping from the HOA spatial encoding stage is applied. Thus, in one embodiment, grouping information is included in the encoded signal. More details about grouping information is provided below.

In one embodiment, a maximum order $N_{MAX}$ is considered for the computation of the truncated HOA representation at the HOA compression stage (see above, near eq.(4)), to and the application of the HOA compressor's and decompressor's Analysis Filter Banks 15, 53 is restricted to only those HOA coefficient sequences $\hat{c}_{T,n}(k)$ with indices n=1, . . . , $O_{MAX}$. The subband signal frames $\tilde{\hat{c}}_{T,n}(k,f_j)$ with indices n=$O_{MAX}$+1, . . . , O can then be set to zero.

Synthesis of Directional Subband HOA Representation

For each subband or subband group, directional subband or subband group HOA representations $\hat{\tilde{\boldsymbol{c}}}_D(k, f_j)$, j=1, . . . , F, are synthesized in one or more Directional Sub-band Synthesis blocks 54. In one embodiment, in order to avoid artifacts due to changes of the directions and prediction coefficients between successive frames, the computation of the directional subband HOA representation is based on the concept of overlap add. Hence, in one embodiment, the HOA representation $\hat{\tilde{\boldsymbol{c}}}_D(k,f_j)$ of active directional sub-band signals related to the $f_j$-th subband, j=1, . . . , F, is computed as the sum of a faded out component and a faded in component:

$$\hat{\tilde{\boldsymbol{c}}}_D(k,f_j)=\hat{\tilde{\boldsymbol{c}}}_{D\,OUT}(k,f_j)+\hat{\tilde{\boldsymbol{c}}}_{D\,IN}(k,f_j). \tag{30}$$

In a first step, to compute the two individual components, the instantaneous frame of all directional subband signals $\tilde{\hat{x}}_I(k_1; k; f_j)$ related to the prediction coefficients matrices $A(k_1, f_j)$ for frames $k_1 \in \{k, k+1\}$ and the truncated subband HOA representation $\tilde{\hat{\mathbf{c}}}_T(k, f_j)$ for the k-th frame is computed by $$\tilde{\hat{x}}_I(k_1;k;f_j)=A(k_1,f_j)\,\tilde{\hat{\mathbf{c}}}_T(k,f_j) \text{ for } k_1\in\{k,k+1\}. \tag{31}$$

For subband groups, the HOA representations of each group $\tilde{\hat{\mathbf{c}}}_T(k, f_j)$ are multiplied by a fixed matrix $A(k_1, f_j)$ to create the subband signals $\tilde{\hat{x}}_I(k_1; k; f_j)$ of the group. In a second step, the instantaneous subband HOA representation $\tilde{\hat{\mathbf{c}}}_{D,I}^{(d)}(k_1; k; f_j)$, $d \in \mathcal{M}_{DIR}(k, f_j)$, j=1, . . . , F, of the directional subband signal $\tilde{\hat{x}}_{I,d}(k_1; k; f_j)$ with respect to the direction $\Omega_{SB,d}(k,f_j)$ is obtained as $$\tilde{\hat{\mathbf{c}}}_{D,I}^{(d)}(k_1;k;f_j)=\psi(\Omega_{SB,d}(k,f_j))\,\tilde{\hat{x}}_{I,d}(k_1;k;f_j) \tag{32}$$

where $\psi(\Omega_{SB,d}(k, f_j)) \in \mathbb{R}^O$ denotes the mode vector (as the mode vectors in eq.(7)) with respect to the direction $\Omega_{SB,d}(k,f_j)$. For subband groups, eq. (32) is performed for all signals of the group, where the matrix $\psi(\Omega_{SB,d}(k, f_j))$ is fixed for each group. Assuming the matrices $\tilde{\hat{\mathbf{c}}}_{D\,OUT}(k, f_j)$, $\tilde{\hat{\mathbf{c}}}_{D\,IN}(k, f_j)$, and $\tilde{\hat{\mathbf{c}}}_{D,I}^{(d)}(k_1; k; f_j)$ to be composed of their samples by $$\hat{C}_{D,OUT}(k, f_j) = \begin{bmatrix} \hat{c}_{D,OUT,1}(k, f_j; 1) & \dots & \hat{c}_{D,OUT,1}(k, f_j; L) \\ \vdots & \ddots & \vdots \\ \hat{c}_{D,OUT,O}(k, f_j; 1) & \dots & \hat{c}_{D,OUT,O}(k, f_j; L) \end{bmatrix} \in \mathbb{R}^{O\times L} \tag{33}$$

$$\hat{C}_{D,IN}(k, f_j) = \begin{bmatrix} \hat{c}_{D,IN,1}(k, f_j; 1) & \dots & \hat{c}_{D,IN,1}(k, f_j; L) \\ \vdots & \ddots & \vdots \\ \hat{c}_{D,IN,O}(k, f_j; 1) & \dots & \hat{c}_{D,IN,O}(k, f_j; L) \end{bmatrix} \in \mathbb{R}^{O\times L} \tag{34}$$

$$\hat{C}_{D,I}^{(d)}(k_1; k; f_j) = \begin{bmatrix} \hat{c}_{D,I,1}^{(d)}(k-1; k; f_j; 1) & \dots & \hat{c}_{D,I,1}^{(d)}(k-1; k; f_j; L) \\ \vdots & \ddots & \vdots \\ \hat{c}_{D,I,O}^{(d)}(k-1; k; f_j; 1) & \dots & \hat{c}_{D,I,O}^{(d)}(k-1; k; f_j; L) \end{bmatrix} \in \mathbb{R}^{O\times L} \tag{35}$$

the sample values of the faded out and faded in components of the HOA representation of active directional subband signals are finally determined by $$\tilde{\hat{c}}_{D,OUT,n}(k,f_j;l)=\Sigma_{d\in J_{DIR}(k,f_j)}\tilde{\hat{\mathbf{c}}}_{D,I,n}^{(d)}(k;k;f_j;l)\cdot w_{OA}(L+l) \tag{36}$$

$$\tilde{\hat{c}}_{D,IN,n}(k;f_j;l)=\Sigma_{d\in J_{DIR}(k+1,f_j)}\tilde{\hat{\mathbf{c}}}_{D,I,n}^{(f_j)}(k+1;k;d;l)\cdot w_{OA}(l) \tag{37}$$

where the vector $$w_{OA}=[w_{OA}(1)\ w_{OA}(2)\ \dots\ w_{OA}(2L)]^T\in\mathbb{R}^{2L} \tag{38}$$

represents an overlap add window function. An example for the window function is given by the periodic Hann window, the elements of which beina defined by $$w_{OA}(l) = \frac{1}{2}\left[1-\cos\left(2\pi\frac{l-1}{2L}\right)\right] \tag{39}$$

Subband HOA Composition

For each subband or subband group $f_j$, j=1, . . . , F, the coefficient sequences $\tilde{\hat{c}}_n(k, f_j)$, n=1, . . . , O, of the decoded subband HOA representation $\tilde{\hat{\mathbf{c}}}(k, f_j)$ are either set to that of the truncated HOA representation $\tilde{\hat{\mathbf{c}}}_T(k,f_j)$ if it was previously transmitted, or else to that of the directional HOA component $\tilde{\hat{\mathbf{c}}}_D(k,f_j)$ provided by one of the Directional Subband Synthesis blocks 54, i.e.

$$\hat{c}_n(k, f_j) = \begin{cases} \hat{c}_{T,n}(k, f_j) & \text{if } n \in \mathcal{J}_{C,ACT}(k) \\ \hat{c}_{D,n}(k, f_j) & \text{else} \end{cases} \tag{40}$$

This subband composition is performed by one or more Subband Composition blocks 55. In an embodiment, a separate Subband Composition block 55 is used for each subband or subband group, and thus for each of the one or more Directional Subband Synthesis blocks 54. In one embodiment, a Directional Subband Synthesis block 54 and its corresponding Subband Composition block 55 are integrated into a single block.

Synthesis Filter Banks

In a final step, the decoded HOA representation is synthesized from all the decoded sub-band HOA representations $\tilde{\hat{\mathbf{c}}}(k,f_j)$, j=1, . . . , F. The individual time domain coefficient sequences $\tilde{\hat{c}}_n(k)$, n=1, . . . , O, of the decompressed HOA representation $\hat{C}(k)$, are synthesized from the corresponding subband coefficient sequences $\tilde{\hat{c}}_n(k, f_j)$, j=1, . . . , F by one or more Synthesis Filter Banks 56, which finally outputs the decompressed HOA representation $\hat{C}(k)$.

Note that the synthesized time domain coefficient sequences usually have a delay due to successive application of the analysis and synthesis filter banks 53, 56.

FIG. 8 shows exemplarily, for a single frequency subband $f_1$, a set of active direction candidates, their chosen trajectories and corresponding tuple sets. In a frame k, four directions are active in a frequency subband $f_1$. The directions belong to respective trajectories $T_1$, $T_2$, $T_3$ and $T_5$. In previous frames k−2 and k−1, different directions were active, namely $T_1$, $T_2$, $T_6$ and $T_1$-$T_4$, respectively. The set of active directions $M_{DIR}(k)$ in the frame k relates to the full band and comprises several active direction candidates, e.g. $M_{DIR}(k)=\{\Omega_3, \Omega_8, \Omega_{52}, \Omega_{101}, \Omega_{229}, \Omega_{446}, \Omega_{581}\}$. Each direction can be expressed in any way, e.g. by two angles or as an index of a predefined table. From the set of active full-band directions, those directions that are actually active in a subband and their corresponding trajectories are collected, separately for each frequency subband, in the tuple sets $M_{DIR}(k,f_j)$, j=1, . . . , F. For example, in the first frequency subband of frame k, active directions are $\Omega_3$, $\Omega_{52}$, $\Omega_{229}$ and $\Omega_{581}$, and their associated trajectories are $T_3$, $T_1$, $T_2$ and $T_5$ respectively. In the second frequency subband $f_2$, active directions are exemplarily only $\Omega_{52}$ and $\Omega_{229}$, and their associated trajectories are $T_1$ and $T_2$ respectively. The following is a portion of a coefficient matrix of an exemplary truncated HOA representation $C_T(k)$, corresponding to the coefficient sequences in an exemplary set $I_{C,ACT}(k)=\{1,2,4,6\}$:

$$C_T(k) = \begin{bmatrix} c_{T,1}(k,1) & c_{T,1}(k,2) & c_{T,1}(k,3) & \dots \\ c_{T,2}(k,1) & c_{T,2}(k,2) & c_{T,2}(k,3) & \dots \\ 0 & 0 & 0 & \dots \\ c_{T,4}(k,1) & c_{T,4}(k,2) & c_{T,4}(k,3) & \dots \\ 0 & 0 & 0 & \dots \\ c_{T,6}(k,1) & c_{T,6}(k,2) & c_{T,6}(k,3) & \dots \\ \dots & \dots & \dots & \dots \end{bmatrix}$$

According to $I_{C,ACT}(k)$, only coefficients of the rows 1, 2, 4 and 6 are not set to zero (nevertheless, they may be zero, depending on the signal). Each column of the matrix $C_T(k)$ refers to a sample, and each row of the matrix is a coefficient sequence. The compression comprises that not all coefficient sequences are encoded and transmitted, but only some selected coefficient sequences, namely those whose indices are included in $I_{C,ACT}(k)$ and the assignment vector $v_A(k)$ respectively. At the decoder, the coefficients are decompressed and positioned into the correct matrix rows of the reconstructed truncated HOA representation. The information about the rows is obtained from the assignment vector $v_{AMB,ASSIGN}(k)$, which provides additionally also the transport channels that are used for each transmitted coefficient sequence. The remaining coefficient sequences are filled with zeros, and later predicted from the received (usually non-zero) coefficients according to the received side information, e.g. the subband or subband group related prediction matrices and directions.

Subband Grouping

In one embodiment, the used subbands have different bandwidths adapted to the psycho-acoustic properties of human hearing. Alternatively, a number of subbands from the Analysis Filter Bank 53 are combined so as to form an adapted filter bank with subbands having different bandwidths. A group of adjacent subbands from the Analysis Filter Bank 53 is processed using the same parameters. If groups of combined subbands are used, the corresponding subband configuration applied at the encoder side must be known to the decoder side. In an embodiment, configuration information is transmitted and is used by the decoder to set up its synthesis filter bank. In an embodiment, the configuration information comprises an identifier for one out of a plurality of predefined known configurations (e.g. in a list).

In another embodiment, the following flexible solution that reduces the required number of bits for defining a subband configuration is used. For an efficient encoding of subband configuration, data of the first, penultimate and last subband groups are treated differently than the other subband groups. Further, subband group bandwidth difference values are used in the encoding. In principle, the subband grouping information coding method is suited for coding subband configuration data for subband groups valid for one or more frames of an audio signal, wherein each subband group is a combination of one or more adjacent original subbands and the number of original subbands is predefined. In one embodiment, the bandwidth of a following subband group is greater than or equal to the bandwidth of a current subband group. The method includes coding a number of $N_{SB}$ subband groups with a fixed number of bits representing $N_{SB}-1$, and if $N_{SB}>1$, coding for a first subband group $g_1$ a bandwidth value $B_{SB}[1]$ with a unary code representing $B_{SB}[1]-1$.If $N_{SB}=3$, a bandwidth difference value $\Delta B_{SB}[2]=B_{SB}[2]-B_{SB}[1]$ with a fixed number of bits is coded for a second subband group $g_2$. If $N_{SB}>3$, a corresponding number of bandwidth difference values $\Delta B_{SB}[g]=B_{SB}[g]-B_{SB}[g-1]$ is coded for the subband groups $g_2, \dots, g_{N_{SB}-2}$ with a unary code, and a bandwidth difference value $\Delta B_{SB}[N_{SB}-1]=B_{SB}[N_{SB}-1]-B_{SB}[N_{SB}-2]$ with a fixed number of bits is coded for the last subband group $g_{N_{SB}-1}$. A bandwidth value for a subband group is expressed as a number of adjacent original subbands. For the last subband group $g_{SB}$, no corresponding value needs to be included in the coded subband configuration data.

Figure 9:
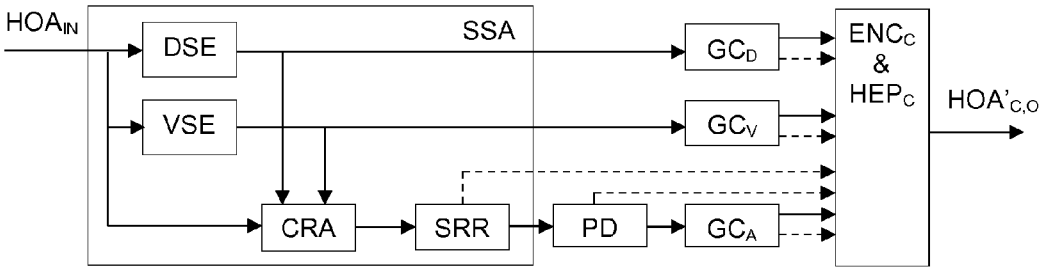

FIG. 9 shows a generalized block diagram of the HOA encoding path of a conventional MPEG-H 3D audio encoder. Two types of predominant sound signals are extracted: directional signals in a Directional Sound Extraction block DSE and vector-based signals VVec in a VVec Sound Extraction block VSE. The vector belonging to a vector-based signal VVec (V-vector) represents the spatial distribution of the soundfield for the corresponding vector-based signal. Further, also an ambiance component is encoded in a Calculator for Residuum/Ambience CRA, whereby any one or both or none of the output data from the Directional Sound Extraction block DSE and the VVec Sound Extraction block VSE can be used. The ambience signal is subjected to Spatial Resolution Reduction block SRR, partial decorrelation PD and gain control $GC_A$. The blocks within the box are controlled by the Sound Scene Analysis SSA. Before being fed into the Universal Speech &Audio encoder USAC3D, also the predominant sound signals are processed by respective gain control blocks $GC_D$,$GC_V$. Finally the USAC3D encoder $ENC_c$&$HEP_C$ packs the HOA spatial side information into the HOA extension payload.

Figure 10:
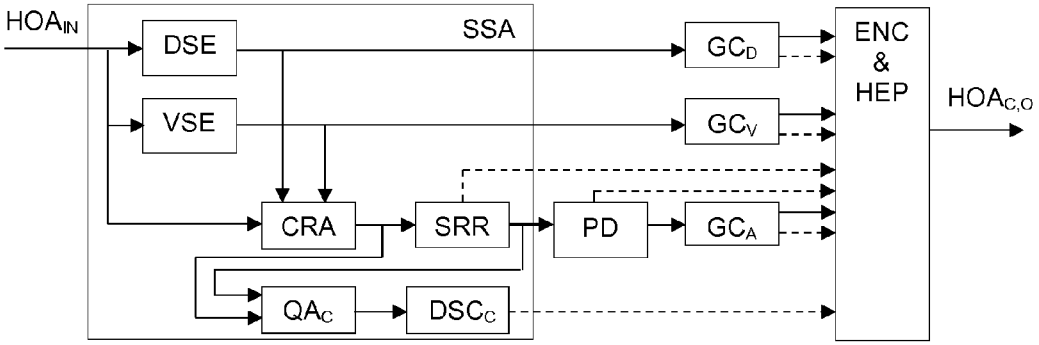

FIG. 10 shows an improved audio encoder as usable in MPEG, according to one embodiment. The disclosed technology amends the current MPEG-H 3D Audio system in a way that the bit stream for low bandwidth is a real superset of the known MPEG-H 3D Audio format. Compared to FIG. 9, in the Sound Scene Analysis SSA a path is added that comprises two new blocks. These are a QMF Analysis Filter bank $QA_C$, which is applied to ambiance signals, and a Directional Subband Calculation block $DSC_C$ for calculation of parameters of directional subband signals. These parameters allow for synthesizing directional signals based on the transmitted ambiance signals. Additionally, parameters are calculated which allow for reproducing missing ambiance signals. The side information parameters for the synthesis process are handed over to the USAC3D encoder ENC&HEP, which packs them into the HOA extension payload of the compressed output signal $HOA_{C,O}$. Advantageously, the compression is more efficient than conventional compression as achieved with the arrangement of FIG. 9.

Figure 11:
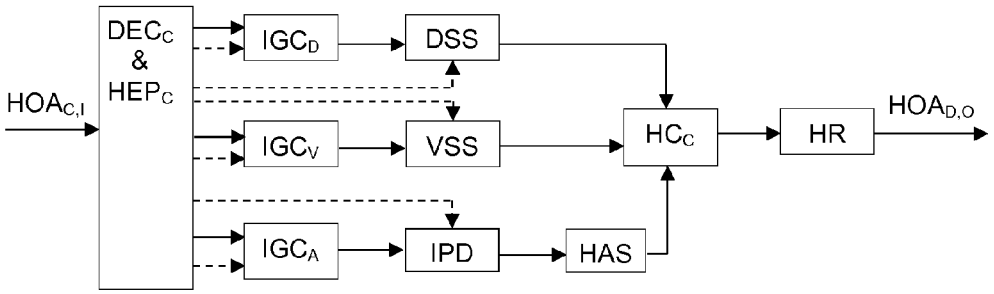

FIG. 11 shows a generalized block diagram of a conventional MPEG-H 3D Audio decoder. First, the HOA side information is extracted from the compressed input bitstream $HOA_{C,I}$ and a USAC3D and HOA Extension Payload decoder $DEC_c$&$HEP_C$ reproduces the transmission channels waveform signals. These are fed into the corresponding inverse gain control blocks $IGC_D$, $IGC_v$, $IGC_A$. Here, the normalization applied in the encoder is reversed. The corresponding transmission channels are used together with the side information to synthesize the predominant sound signals (directional and/or vector-based) in a HOA Directional Sound Synthesis block DSS and/or a VVec Sound Synthesis block VSS respectively. In the third path, the ambiance component is reproduced by Inverse Partial Decorrelation IPD and HOA Ambience Synthesis HAS blocks. The following HOA Composition block $HC_c$ combines the predominant sound components and the ambiance to build the decoded HOA signal. This is fed into the HOA renderer HR to produce the output signal $HOA'_{D,O}$, ie. the final loudspeaker feeds.

Figure 12:
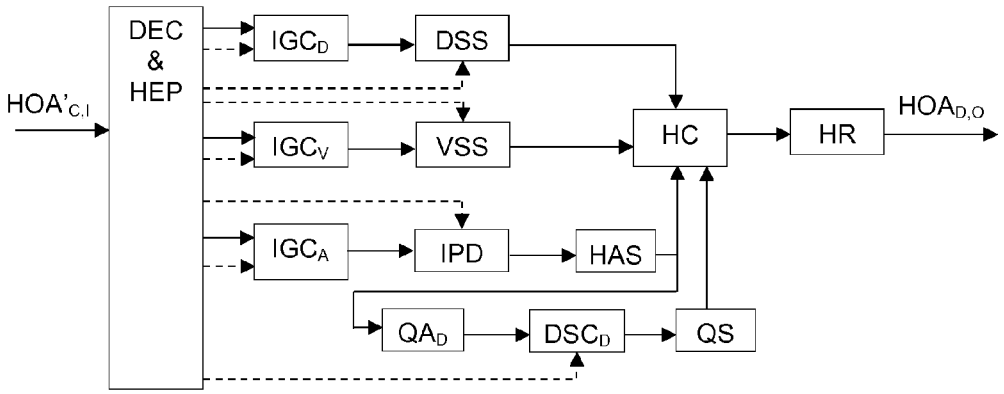

FIG. 12 shows an improved audio decoder as usable in MPEG, according to one embodiment. As in the encoder, a path is added. It comprises a decoder side QMF Analysis block $QA_D$ for calculation of subband signals and a Directional Subband signal Synthesis block $DSC_D$ for the synthesis of the parametrically encoded directional subband signals. The calculated subband signals are used together with the corresponding transmitted side information to synthesize a HOA representation of directional signals. Afterwards, the synthesized signal component is transferred into the time domain using the QMF synthesis filter bank QS. Its output signal is additionally fed into the enhanced HOA composition block HC. The following HOA rendering block HR for providing a decoded HOA output signal $HOA_{D,O}$ is left unchanged.

In the following, some basic features of Higher Order Ambisonics are explained. Higher Order Ambisonics (HOA) is based on the description of a sound field within a compact area of interest, which is assumed to be free of sound sources. In that case the spatiotemporal behavior of the sound pressure p(t, x) at time t and position x within the area of interest is physically fully determined by the homogeneous wave equation. In the following we assume a spherical coordinate system as shown in FIG. 6. In this coordinate system, the x axis points to the frontal position, the y axis points to the left, and the z axis points to the top. A position in space $x=(r, \theta, \phi)^T$ is represented by a radius r>0 (i.e. the distance to the coordinate origin), an inclination angle $\theta \in [0,\pi]$ measured from the polar axis z (!) and an azimuth angle $\phi \in [0,2\pi[$ measured counter-clockwise in the x−y plane from the x axis. Further, $(\bullet)^T$ denotes the transposition.

Then, it can be shown [11] that the Fourier transform of the sound pressure with respect to time denoted by $F_t(\bullet)$, i.e., $$P(\omega,x)=F_t(p(t,x))=\int_{-\infty}^{\infty}p(t,x)e^{-i\omega t}dt \tag{41}$$

with ω denoting the angular frequency and i indicating the imaginary unit, may be expanded into the series of Spherical Harmonics according to $$P(\omega=kc_s,r,\theta,\phi)=\sum_{n=0}^{N}\sum_{m=-n}^{n}A_n^m(k)j_n(kr)S_n^m(\theta,\phi) \tag{42}$$

In eq.(42), $c_s$ denotes the speed of sound and k denotes the angular wave number, which is related to the angular frequency ω by $$k=\frac{\omega}{c_s}.$$

Further, $j_n(\bullet)$ denote the spherical Bessel functions of the first kind and $S_n^m(\theta, \phi)$ denote the real valued Spherical Harmonics of order n and degree m, which are defined above. The expansion coefficients $A_n^m(k)$ only depend on the angular wave number k. Note that it has been implicitly assumed that sound pressure is spatially band-limited. Thus, the series is truncated with respect to the order index n at an upper limit N, which is called the order of the HOA representation.

If the sound field is represented by a superposition of an infinite number of harmonic plane waves of different angular frequencies ω and arriving from all possible directions specified by the angle tuple (θ, ϕ), it can be shown [10] that the respective plane wave complex amplitude function C(ω, θ, ϕ) can be expressed by the following Spherical Harmonics expansion $$C(\omega=kc_s,\theta,\phi)=\sum_{n=0}^{N}\sum_{m=-n}^{n}C_n^m(k)S_n^m(\theta,\phi) \tag{43}$$

where the expansion coefficients $C_n^m(k)$ are related to the expansion coefficients $A_n^m(k)$ by $$A_n^m(k)=i^nC_n^m(k). \tag{44}$$

Assuming the individual coefficients $C_n^m(k=\omega/c_s)$ to be functions of the angular frequency ω, the application of the inverse Fourier transform (denoted by $F^{-1}(\bullet)$) provides time domain functions $$c_n^m(t)=\mathcal{F}_t^{-1}(C_n^m(\omega/c_s))=\frac{1}{2\pi}\int_{-\infty}^{\infty}C_n^m\left(\frac{\omega}{c_s}\right)e^{i\omega t}d\omega \tag{45}$$

for each order n and degree m. These time domain functions are referred to as continuous-time HOA coefficient sequences here, which can be collected in a single vector c(t) by $$c(t)=[\,c_0^0(t)\;\;c_1^{-1}(t)\;\;c_1^0(t)\;\;c_1^1(t)\;\;c_2^{-2}(t)\;\;c_2^{-1}(t)\;\;c_2^0(t)\;\;c_2^1(t)\;\;c_2^2(t)\;\;\ldots\;\;c_N^{N-1}(t)\;\;c_N^N(t)\,]^T \tag{46}$$

The position index of a HOA coefficient sequence $c_n^m(t)$ within the vector c(t) is given by n(n+1)+1+m.

The overall number of elements in the vector c(t) is given by $O=(N+1)^2$.

The final Ambisonics format provides the sampled version of c(t) using a sampling frequency $f_S$ as $$\{c(lT_S)\}_{l\in N}=\{c(T_S),c(2T_S),c(3T_S),c(4T_S),\ldots\} \tag{47}$$

where $T_S=1/f_S$ denotes the sampling period. The elements of $c(lT_S)$ are here referred to as discrete-time HOA coefficient sequences, which can be shown to always be real valued. This property obviously also holds for the continuous-time versions $c_n^m(t)$.

Definition of Real Valued Spherical Harmonics

The real valued spherical harmonics $S_n^m(\theta, \phi)$ (assuming SN3D normalization [1, Ch.3.1]) are given by $$S_n^m(\theta,\ \phi)=\sqrt{(2n+1)\frac{(n-|m|)!}{(n+|m|)!}}\,P_{n,|m|}(\cos\theta)trg_m(\phi) \tag{48}$$

with $$trg_m(\phi)=\begin{cases}\sqrt{2}\cos(m\phi) & m>0\\ 1 & m=0\\ -\sqrt{2}\sin(m\phi) & m<0\end{cases} \tag{49}$$

The associated Legendre functions $P_{n,m}(x)$ are defined as $$P_{n,m}(x)=(1-x^2)^{m/2}\frac{d^m}{dx^m}P_n(x),\ m\geq 0 \tag{50}$$

with the Legendre polynomial $P_n(x)$ and, unlike in [11], without the Condon-Shortley phase term $(-1)^m$.

In one embodiment, a method for frame-wise determining and efficient encoding of directions of dominant directional signals within subbands or subband groups of a HOA signal representation (as obtained from a complex valued filter bank) comprises for each current frame k: determining a set $M_{DIR}(k)$ of full band direction candidates in the HOA signal, a number of elements NoOfGlobalDirs in the set $M_{DIR}(k)$ and a number $D(k)=\log_2(\text{NoOfGlobalDirs})$ required for encoding the number of elements, wherein each full band direction candidate has a global index q ($q \in [1, \ldots, Q]$) relating to a predefined full set of Q possible directions, for each subband or subband group j of the current frame k, determining which directions of the full band direction candidates in the set $M_{DIR}(k)$ occur as active subband directions, determining a set $M_{FB}(k)$ of used full band direction candidates (all contained in the set $M_{DIR}(k)$ of full band direction candidates in the HOA signal) that occur as active subband directions in any of the subbands or subband groups, and a number NoOfGlobalDirs(k) of elements in the set $M_{FB}(k)$ of used full band direction candidates, and for each subband or subband group j of the current frame k: determining which directions of up to d ($d \in [1, \ldots, D]$) directions among the full band direction candidates in the set $M_{DIR}(k)$ are active subband directions, determining for each of the active subband directions a trajectory and a trajectory index, and assigning the trajectory index to each active subband direction, and encoding each of the active subband directions in the current subband or subband group j by a relative index with D(k) bits.

In one embodiment, a computer readable medium has stored thereon executable instructions to cause a computer to perform this method for frame-wise determining and efficient encoding of directions of dominant directional signals.

Further, in one embodiment, a method for decoding of directions of dominant directional signals within subbands of a HOA signal representation comprises steps of receiving indices of a maximum number of directions D for a HOA signal representation to be decoded, reconstructing directions of a maximum number of directions D of the HOA signal representation to be decoded, receiving indices of active direction signals per subband, reconstructing active directions per subband from the reconstructed directions D of the HOA signal representation to be decoded and the indices of active direction signals per subband, predicting directional signals of subbands, wherein the predicting of a directional signal in a current frame of a subband comprises determining directional signals of a preceding frame of the subband, and wherein a new directional signal is created if the index of the directional signal was zero in the preceding frame and is non-zero in the current frame, a previous directional signal is cancelled if the index of the directional signal was non-zero in the preceding frame and is zero in the current frame, and a direction of a directional signal is moved from a first to a second direction if the index of the directional signal changes from the first to the second direction.

In one embodiment, as shown in FIG. 1 and FIG. 3 and discussed above, an apparatus for encoding frames of an input HOA signal having a given number of coefficient sequences, where each coefficient sequence has an index, comprises at least one hardware processor and a non-transitory, tangible, computer readable storage medium tangibly embodying at least one software component that when executing on the at least one hardware processor causes the hardware processor to compute 11 a truncated HOA representation $C_T(k)$ having a reduced number of non-zero coefficient sequences, determine 11 a set of indices of active coefficient sequences $I_{C,ACT}(k)$ that are included in the truncated HOA representation, estimate 16 from the input HOA signal a first set of candidate directions $M_{DIR}(k)$;

divide 15 the input HOA signal into a plurality of frequency subbands $f_1, \ldots, f_F$, wherein coefficient sequences $\tilde{\tilde{C}}(k-1, k, f_1), \ldots, \tilde{\tilde{C}}(k-1, k, f_F)$ of the frequency subbands are obtained, estimate 16 for each of the frequency subbands a second set of directions $M_{DIR}(k,f_1), \ldots, M_{DIR}(k,f_F)$, wherein each element of the second set of directions is a tuple of indices with a first and a second index, the second index being an index of an active direction for a current frequency subband and the first index being a trajectory index of the active direction, wherein each active direction is also included in the first set of candidate directions $M_{DIR}(k)$ of the input HOA signal, for each of the frequency subbands, compute 17 directional subband signals $\tilde{\tilde{X}}(k-1, k, f_1), \ldots, \tilde{\tilde{X}}(k-1, k, f_F)$ from the coefficient sequences $\tilde{\tilde{C}}(k-1, k, f_1), \ldots, \tilde{\tilde{C}}(k-1, k, f_F)$ of the frequency subband according to the second set of directions $M_{DIR}(k,f_1), \ldots, M_{DIR}(k,f_F)$ of the respective frequency subband, for each of the frequency subbands, calculate 18 a prediction matrix $A(k,f_1), \ldots, A(k,f_F)$ adapted for predicting the directional subband signals $\tilde{\tilde{X}}(k-1, k, f_1), \ldots, \tilde{\tilde{X}}(k-1, k, f_F)$ from the coefficient sequences $\tilde{\tilde{C}}(k-1, k, f_1), \ldots, \tilde{\tilde{C}}(k-1, k, f_F)$ of the frequency subband using the set of indices of active coefficient sequences $I_{C,ACT}(k)$ of the respective frequency subband, and encode the first set of candidate directions $M_{DIR}(k)$, the second set of directions $M_{DIR}(k,f_1), \ldots, M_{DIR}(k,f_F)$, the prediction matrices $A(k,f_1), \ldots, A(k,f_F)$ and the truncated HOA representation $C_T(k)$.

In one embodiment, as shown in FIG. 4 and FIG. 5 and discussed above, an apparatus for decoding a compressed HOA representation comprises at least one hardware processor and a non-transitory, tangible, computer readable storage medium tangibly embodying at least one software component that when executing on the at least one hardware processor causes the hardware processor to extract 41, 42, 43 from the compressed HOA representation a plurality of truncated HOA coefficient sequences $\hat{z}_1(k), \ldots, \hat{z}_I(k)$, an assignment vector $v_{AMB,ASSIGN}(k)$ indicating or containing sequence indices of said truncated HOA coefficient sequences, subband related direction information $M_{DIR}(k+1,f_1), \ldots, M_{DIR}(k+1,f_F)$, a plurality of prediction matrices $A(k+1,f_1), \ldots, A(k+1,f_F)$, and gain control side information $e_1(k), \beta_1(k), \ldots, e_I(k), \beta_I(k)$;

reconstruct 51, 52 a truncated HOA representation $\hat{C}_T(k)$ from the plurality of truncated HOA coefficient sequences $\hat{z}_1(k), \ldots, \hat{z}_I(k)$, the gain control side information $e_1(k), \beta_1(k), \ldots, e_I(k), \beta_I(k)$ and the assignment vector $v_{AMB,ASSIGN}(k)$, decompose in one or more Analysis Filter banks 53 the reconstructed truncated HOA representation $\hat{C}_T(k)$ into frequency subband representations $\hat{\tilde{\tilde{c}}}_T(k, f_1), \ldots, \hat{\tilde{\tilde{c}}}_T(k, f_F)$ for a plurality of F frequency subbands, synthesize 54 in Directional Subband Synthesis blocks 54 for each of the frequency subband representations a predicted directional HOA representation $\hat{\tilde{\tilde{c}}}_D(k, f_1), \ldots, \hat{\tilde{\tilde{c}}}_D(k,$ $f_F$) from the respective frequency subband representation $\hat{\hat{\tilde{c}}}_T(k, f_1), \ldots, \hat{\hat{\tilde{c}}}_T(k, f_F)$ of the reconstructed truncated HOA representation, the subband related direction information $M_{DIR}(k+1,f_1), \ldots, M_{DIR}(k+1,f_F)$ and the prediction matrices $A(k+1,f_1), \ldots, A(k+1,f_F)$, compose 55 in Subband Composition blocks 55 for each of the F frequency subbands a decoded subband HOA representation $\hat{\hat{\tilde{c}}}(k, f_1), \ldots, \hat{\hat{\tilde{c}}}(k, f_F)$ with coefficient sequences $\hat{\tilde{c}}_n(k, f_j)$, n=1, . . . , O that are either obtained from coefficient sequences of the truncated HOA representation $\hat{\hat{\tilde{c}}}_T(k, f_j)$ if the coefficient sequence has an index n that is included in the assignment vector $v_{AMB,ASSIGN}(k)$, or otherwise obtained from coefficient sequences of the predicted directional HOA component $\hat{\hat{\tilde{c}}}_D(k, f_j)$ provided by one of the Directional Subband Synthesis blocks 54, and synthesize in one or more Synthesis Filter banks 56 the decoded subband HOA representations $\hat{\hat{\tilde{c}}}(k, f_1), \ldots, \hat{\hat{\tilde{c}}}(k, f_F)$ to obtain the decoded HOA representation $\hat{C}(k)$.

In one embodiment, an apparatus 10 for encoding frames of an input HOA signal having a given number of coefficient sequences, where each coefficient sequence has an index, comprises a computation and determining module 11 configured to compute a truncated HOA representation $C_T(k)$ having a reduced number of non-zero coefficient sequences, and further configured to determine a set of indices of active coefficient sequences $I_{C,ACT}(k)$ included in the truncated HOA representation;

an Analysis Filter bank module 15 configured to divide the input HOA signal into a plurality of frequency subbands $f_1, \ldots, f_F$, wherein coefficient sequences $\tilde{\tilde{C}}(k-1, k, f_1), \ldots, \tilde{\tilde{C}}(k-1, k, f_F)$ of the frequency subbands are obtained;

a Direction Estimation module 16 configured to estimate from the input HOA signal a first set of candidate directions $M_{DIR}(k)$, and further configured to estimate for each of the frequency subbands a second set of directions $M_{DIR}(k,f_1), \ldots, M_{DIR}(k,f_F)$, wherein each element of the second set of directions is a tuple of indices with a first and a second index, the second index being an index of an active direction for a current frequency subband and the first index being a trajectory index of the active direction, wherein each active direction is also included in the first set of candidate directions $M_{DIR}(k)$ of the input HOA signal; at least one Directional Subband Computation module 17 configured to compute, for each of the frequency subbands, directional subband signals $\tilde{\tilde{X}}(k-1, k, f_1), \ldots, \tilde{\tilde{X}}(k-1, k, f_F)$ from the coefficient sequences $\tilde{\tilde{C}}(k-1, k, f_1), \ldots, \tilde{\tilde{C}}(k-1, k, f_F)$ of the frequency subband according to the second set of directions $M_{DIR}(k,f_1), \ldots, M_{DIR}(k,f_F)$ of the respective frequency subband; at least one Directional Subband Prediction module 18 configured to calculate, for each of the frequency subbands, a prediction matrix $A(k,f_1), \ldots, A(k,f_F)$ adapted for predicting the directional subband signals $\tilde{\tilde{X}}(k-1, k, f_1), \ldots, \tilde{\tilde{X}}(k-1, k, f_F)$ from the coefficient sequences $\tilde{\tilde{C}}(k-1, k, f_1), \ldots, \tilde{\tilde{C}}(k-1, k, f_F)$ of the frequency subband using the set of indices of active coefficient sequences $I_{C,ACT}(k)$ of the respective frequency subband; and an encoding module 30 configured to encode the first set of candidate directions $M_{DIR}(k)$, the second set of directions $M_{DIR}(k,f_1), \ldots, M_{DIR}(k,f_F)$, the prediction matrices $A(k,f_1), \ldots, A(k,f_F)$ and the truncated HOA representation $C_T(k)$.

In one embodiment, the apparatus further comprises a Partial Decorrelator 12 configured to partially decorrelate the truncated HOA channel sequences; a Channel Assignment module 13 configured to assigning the truncated HOA channel sequences $y_1(k), \ldots, y_I(k)$ to transport channels; and at least one Gain Control unit 14 configured to perform gain control on the transport channels, wherein gain control side information $e_i(k-1)$, $\beta_i(k-1)$ for each transport channel is generated.

In one embodiment, the encoding module 30 comprises a Perceptual Encoder 31 configured to encode the gain controlled truncated HOA channel sequences $z_1(k), \ldots, z_I(k)$; a Side Information Source Coder 32 configured to encode the gain control side information $e_i(k-1)$, $\beta_i(k-1)$, the first set of candidate directions $M_{DIR}(k)$, the second set of directions $M_{DIR}(k,f_1), \ldots, M_{DIR}(k,f_F)$ and the prediction matrices $A(k,f_1), \ldots, A(k,f_F)$; and a Multiplexer 33 configured to multiplex the outputs of the perceptual encoder 31 and the side information source coder 32 to obtain an encoded HOA signal frame $\breve{B}(k-1)$.

In one embodiment, an apparatus 50 for decoding a HOA signal comprises an Extraction module 40 configured to extract from the compressed HOA representation a plurality of truncated HOA coefficient sequences $\hat{z}_1(k), \ldots, \hat{z}_I(k)$, an assignment vector $v_{AMB,ASSIGN}(k)$ indicating or containing sequence indices of said truncated HOA coefficient sequences, subband related direction information $M_{DIR}(k+1,f_1), \ldots, M_{DIR}(k+1,f_F)$, a plurality of prediction matrices $A(k+1,f_1), \ldots, A(k+1,f_F)$, and gain control side information $e_1(k), \beta_1(k), \ldots, e_I(k), \beta_I(k)$; a Reconstruction module 51, 52 configured to reconstruct a truncated HOA representation $\hat{C}_T(k)$ from the plurality of truncated HOA coefficient sequences $\hat{z}_1(k), \ldots, \hat{z}_I(k)$, the gain control side information $e_1(k), \beta_1(k), \ldots, e_I(k), \beta_I(k)$ and the assignment vector $v_{AMB,ASSIGN}(k)$; an Analysis Filter bank module 53 configured to decompose the reconstructed truncated HOA representation $\hat{C}_T(k)$ into frequency subband representations $\hat{\hat{\tilde{c}}}_T(k, f_1), \ldots, \hat{\hat{\tilde{c}}}_T(k, f_F)$ for a plurality of F frequency subbands; at least one Directional Subband Synthesis module 54 configured to synthesize for each of the frequency subband representations a predicted directional HOA representation $\hat{\hat{\tilde{c}}}_D(k, f_1), \ldots, \hat{\hat{\tilde{c}}}_D(k, f_F)$ from the respective frequency subband representation $\hat{\hat{\tilde{c}}}_T(k, f_1), \ldots, \hat{\hat{\tilde{c}}}_T(k, f_F)$ of the reconstructed truncated HOA representation, the subband related direction information $M_{DIR}(k+1,f_1), \ldots, M_{DIR}(k+1,f_F)$ and the prediction matrices $A(k+1,f_1), \ldots, A(k+1,f_F)$;

at least one Subband Composition module 55 configured to compose for each of the F frequency subbands a decoded subband HOA representation $\hat{\hat{\tilde{c}}}(k, f_1), \ldots, \hat{\hat{\tilde{c}}}(k, f_F)$ with coefficient sequences $\hat{\tilde{c}}_n(k, f_j)$, n=1, . . . , O that are either obtained from coefficient sequences of the truncated HOA representation $\hat{\hat{\tilde{c}}}_T(k, f_j)$ if the coefficient sequence has an index n that is included in the assignment vector $v_{AMB,ASSIGN}(k)$, or otherwise obtained from coefficient sequences of the predicted directional HOA component $\hat{\hat{\tilde{c}}}_D(k, f_j)$ provided by one of the Directional Subband Synthesis module 54; and a Synthesis Filter bank module 56 configured to synthesize the decoded subband HOA representations $\hat{\hat{\tilde{c}}}(k, f_1), \ldots, \hat{\hat{\tilde{c}}}(k, f_F)$ to obtain the decoded HOA representation $\hat{C}(k)$.

In one embodiment, the Extraction module 40 comprises at least a Demultiplexer 41 for obtaining an encoded side information portion and a perceptually coded portion that comprises encoded truncated HOA coefficient sequences $\check{z}_1(k), \ldots, \check{z}_I(k)$; a Perceptual Decoder 42 configured to perceptually decode s42 the encoded truncated HOA coefficient sequences $\check{z}_1(k), \ldots, \check{z}_I(k)$ to obtain the truncated HOA coefficient sequences $\hat{z}_1(k), \ldots, \hat{z}_I(k)$; and a Side Information Source Decoder 43 configured to decode (s43) the encoded side information portion to obtain the subband related direction information $M_{DIR}(k+1,f_1), \ldots, M_{DIR}(k+1,f_F)$, prediction matrices $A(k+1,f_1), \ldots, A(k+1,f_F)$, gain control side information $e_1(k), \beta_1(k), \ldots, e_I(k), \beta_I(k)$ and assignment vector $v_{AMB,ASSIGN}(k)$.

Figure 13:
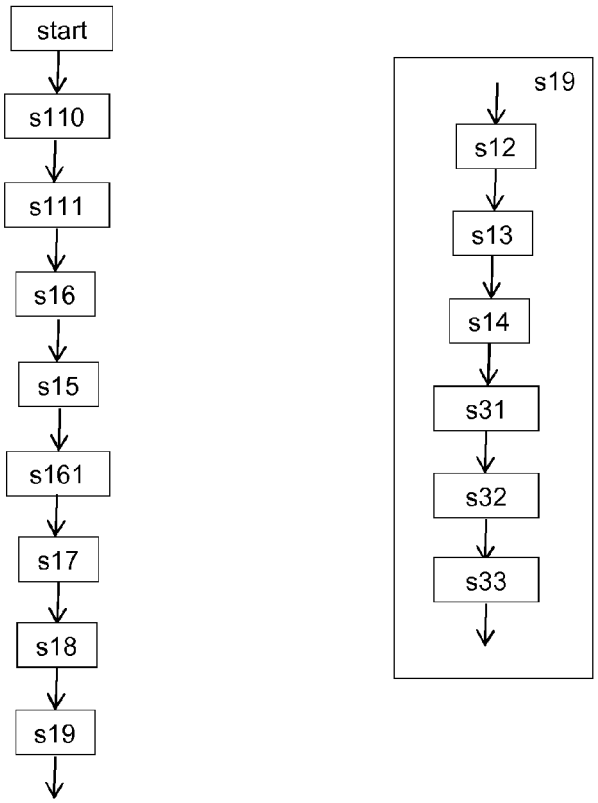

FIG. 13 shows a flow-chart of a low bit-rate encoding method, in one embodiment. The method for low bit-rate encoding of frames of an input HOA signal having a given number of coefficient sequences, where each coefficient sequence has an index, comprises computing s110 a truncated HOA representation $C_T(k)$ having a reduced number of non-zero coefficient sequences, determining s111 a set of indices of active coefficient sequences $I_{C,ACT}(k)$ that are included in the truncated HOA representation, estimating s16 from the input HOA signal a first set of candidate directions $M_{DIR}(k)$, dividing s15 the input HOA signal into a plurality of frequency subbands $f_1, \ldots, f_F$, wherein coefficient sequences $\bar{\bar{C}}(k-1, k, f_1), \ldots, \bar{\bar{C}}(k-1, k, f_F)$ of the frequency subbands are obtained, estimating s161 for each of the frequency subbands a second set of directions $M_{DIR}(k,f_1), \ldots, M_{DIR}(k,f_F)$, wherein each element of the second set of directions is a tuple of indices with a first and a second index, the second index being an index of an active direction for a current frequency subband and the first index being a trajectory index of the active direction, wherein each active direction is also included in the first set of candidate directions $M_{DIR}(k)$ of the input HOA signal, for each of the frequency subbands, computing s17 directional subband signals $\bar{\bar{X}}(k-1, k, f_1), \ldots, \bar{\bar{X}}(k-1, k, f_F)$ from the coefficient sequences $\bar{\bar{C}}(k-1, k, f_1), \ldots, \bar{\bar{C}}(k-1, k, f_F)$ of the frequency subband according to the second set of directions $M_{DIR}(k,f_1), \ldots, M_{DIR}(k,f_F)$ of the respective frequency subband, for each of the frequency subbands, calculating s18 a prediction matrix $A(k,f_1), \ldots, A(k,f_F)$ adapted for predicting the directional subband signals $\bar{\bar{X}}(k-1, k, f_1), \ldots, \bar{\bar{X}}(k-1, k, f_F)$ from the coefficient sequences $\bar{\bar{C}}(k-1, k, f_1), \ldots, \bar{\bar{C}}(k-1, k, f_F)$ of the frequency subband using the set of indices of active coefficient sequences $I_{C,ACT}(k)$ of the respective frequency subband, and encoding s19 the first set of candidate directions $M_{DIR}(k)$, the second set of directions $M_{DIR}(k,f_1), \ldots, M_{DIR}(k,f_F)$, the prediction matrices $A(k,f_1), \ldots, A(k,f_F)$ and the truncated HOA representation $C_T(k)$.

In one embodiment, said encoding the truncated HOA representation $C_T(k)$ comprises partial decorrelation s12 of the truncated HOA channel sequences, channel assignment s13 for assigning the truncated HOA channel sequences $y_1(k), \ldots, y_I(k)$ to transport channels, performing gain control s14 on each of the transport channels, wherein gain control side information $e_i(k-1), \beta_i(k-1)$ for each transport channel is generated, encoding s31 the gain controlled truncated HOA channel sequences $z_1(k), \ldots, z_I(k)$ in a perceptual encoder 31, encoding s32 the gain control side information $e_i(k-1), \beta_i(k-1)$, the first set of candidate directions $M_{DIR}(k)$, the second set of directions $M_{DIR}(k,f_1), \ldots, M_{DIR}(k,f_F)$ and the prediction matrices $A(k,f_1), \ldots, A(k,f_F)$ in a side information source coder 32, and multiplexing s33 the outputs of the perceptual encoder 31 and the side information source coder 32 to obtain an encoded HOA signal frame $\check{B}(k-1)$.

In one embodiment, an apparatus for encoding frames of an input HOA signal having a given number of coefficient sequences, where each coefficient sequence has an index, comprises a processor and a memory storing instructions that, when executed by the processor, cause the processor to perform the steps of claim 8.

Figure 14:
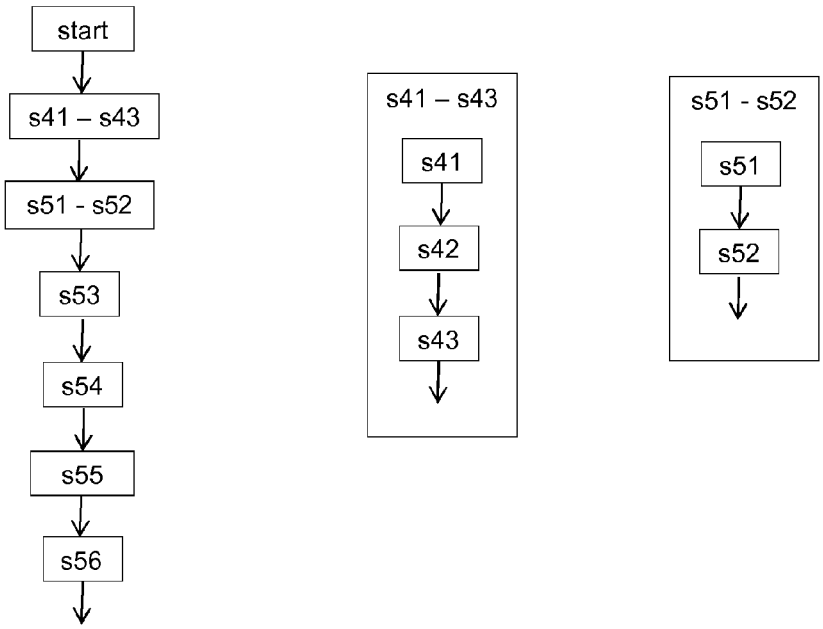

FIG. 14 shows a flow-chart of a decoding method, in one embodiment. The method for decoding a low bit-rate compressed HOA representation, comprises extracting s41,s42, s43 from the compressed HOA representation a plurality of truncated HOA coefficient sequences $\hat{z}_1(k), \ldots, \hat{z}_1(k)$, an assignment vector $v_{AMB,ASSIGN}(k)$ indicating or containing sequence indices of said truncated HOA coefficient sequences, subband related direction information $M_{DIR}(k+1,f_1), \ldots, M_{DIR}(k+1,f_F)$, a plurality of prediction matrices $A(k+1,f_1), \ldots, A(k+1,f_F)$, and gain control side information $e_1(k), \beta_1(k), \ldots, e_I(k), \beta_I(k)$, reconstructing s51,s52 a truncated HOA representation $\hat{C}_T(k)$ from the plurality of truncated HOA coefficient sequences $\hat{z}_1(k), \ldots, \hat{z}_I(k)$, the gain control side information $e_1(k), \beta_1(k), \ldots, e_I(k), \beta_I(k)$ and the assignment vector $v_{AMB,ASSIGN}(k)$, decomposing s53 in Analysis Filter banks 53 the reconstructed truncated HOA representation ($\hat{C}_T(k)$) into frequency subband representations $\hat{\hat{c}}_T(k,f_1), \ldots, \hat{\hat{c}}_T(k, f_F)$ for a plurality of F frequency subbands, synthesizing s54 in Directional Subband Synthesis blocks 54 for each of the frequency subband representations a predicted directional HOA representation $\hat{\hat{c}}_D(k,f_1), \ldots, \hat{\hat{c}}_D(k, f_F)$ from the respective frequency subband representation $\hat{\hat{c}}_T(k, f_1), \ldots, \hat{\hat{c}}_T(k, f_F)$ of the reconstructed truncated HOA representation, the subband related direction information $M_{DIR}(k+1,f_1), \ldots, M_{DIR}(k+1,f_F)$ and the prediction matrices $A(k+1,f_1), \ldots, A(k+1,f_F)$, composing s55 in Subband Composition blocks 55 for each of the F frequency subbands a decoded subband HOA representation $\hat{\hat{c}}(k, f_1), \ldots, \hat{\hat{c}}(k, f_F)$ with coefficient sequences $\tilde{\hat{c}}_n(k, f_j)$, n=1, . . . , O that are either obtained from coefficient sequences of the truncated HOA representation $\hat{\hat{c}}_T(k,f_j)$ if the coefficient sequence has an index n that is included in the assignment vector $v_{AMB,ASSIGN}(k)$, or otherwise obtained from coefficient sequences of the predicted directional HOA component $\hat{\hat{c}}_D(k, f_j)$ provided by one of the Directional Subband Synthesis blocks 54, and synthesizing s56 in Synthesis Filter banks 56 the decoded subband HOA representations $\hat{\hat{c}}(k,f_1), \ldots, \hat{\hat{c}}(k, f_F)$ to obtain the decoded HOA representation $\hat{C}(k)$.

In an embodiment, the extracting comprises one or more of demultiplexing s41 the compressed HOA representation to obtain a perceptually coded portion and an encoded side information portion, perceptually decoding s42 the encoded truncated HOA coefficient sequences and decoding s43 in a side information source decoder 43 the encoded side information. In an embodiment, the reconstructing a truncated HOA representation $\hat{C}_T(k)$ from the plurality of truncated HOA coefficient sequences comprises one or more of performing inverse gain control s51 and reconstructing s52 the truncated HOA representation $\hat{C}_T(k)$.

In one embodiment, a computer readable medium has stored thereon executable instructions to cause a computer to perform said method for decoding of directions of dominant directional signals.

In one embodiment, an apparatus for decoding a compressed HOA signal comprises a processor and a memory storing instructions that, when executed by the processor, cause the processor to perform the steps of claim 1.

It is expressly intended that all combinations of those elements that perform substantially the same function in substantially the same way to achieve the same results are within the scope of the invention, and that each feature disclosed in the description and (where appropriate) the claims and drawings may be provided independently or in any appropriate combination. Features may, where appropriate be implemented in hardware, software, or a combination of the two. Connections may, where applicable, be implemented as wireless connections or wired, not necessarily direct or dedicated, connections. In one embodiment, each of the above mentioned modules or units, such as Extraction module, Gain Control units, sub-band signal grouping units, processing units and others, is at least partially implemented in hardware by using at least one silicon component.

REFERENCES

[1] Jérôme Daniel. *Représentation de champs acoustiques, application à la transmission et à la reproduction de scènes sonores complexes dans un contexte multimédia*. PhD thesis, Université Paris 6, 2001.

[2] Jörg Fliege and Ulrike Maier. A two-stage approach for computing cubature formulae for the sphere. Technical report, Fachbereich Mathematik, Universität Dortmund, 1999. Node numbers are found at http://www.mathematik.uni-dortmund.de/lsx/research/projects/fliege/nodes/nodes.html.

[3] Sven Kordon and Alexander Krueger. Adaptive value range control for HOA signals. Patent application (Technicolor Internal Reference: PD130016), July 2013.

[4] Alexander Krueger and Sven Kordon. Intelligent signal extraction and packing for compression of HOA sound field representations. Patent application EP 13305558.2 (Technicolor Internal Reference: PD130015), filed 29. Apr. 2013.

[5] A. Krueger, S. Kordon, and J. Boehm. HOA compression by decomposition into directional and ambient components. Published patent application EP2743922 (Technicolor Internal Reference: PD120055), December 2012.

[6] Alexander Kruger, Sven Kordon, Johannes Boehm, and Jan-Mark Batke. Method and apparatus for compressing and decompressing a higher order ambisonics signal representation. Published patent application EP2665208 (Technicolor Internal Reference: PD120015), May 2012.

[7] Alexander Krüger. Method and apparatus for robust sound source direction tracking based on Higher Order Ambisonics. Published patent application EP2738962 (Technicolor Internal Reference: PD120049), November 2012.

[8] Daniel D. Lee and H. Sebastian Seung. Learning the parts of objects by nonnegative matrix factorization. *Nature*, 401:788-791, 1999.

[9] ISO/IEC JTC 1/SC 29 N. Text of ISO/IEC 23008-3/CD, MPEG-H 3d audio, April 2014.

[10] Boaz Rafaely. Plane-wave decomposition of the sound field on a sphere by spherical convolution. *J. Acoust. Soc. Am.*, 4(116):2149-2157, October 2004.

[11] Earl G. Williams. *Fourier Acoustics*, volume 93 of *Applied Mathematical Sciences*. Academic Press, 1999.

The invention claimed is:

1. A method for decoding a compressed HOA representation, comprising extracting from the compressed HOA representation a plurality of truncated HOA coefficient sequences ($\hat{z}_1(k), \ldots, \hat{z}_1(k)$), an assignment vector ($v_{AMB,ASSIGN}(k)$) indicating or containing sequence indices of said truncated HOA coefficient sequences, subband related direction information ($M_{DIR}(k+1,f_1), \ldots, M_{DIR}(k+1,f_F)$), a plurality of prediction matrices ($A(k+1,f_1), \ldots, A(k+1,f_F)$), and gain control side information ($e_1(k), \beta_1(k), \ldots, e_I(k), \beta_I(k)$);

reconstructing a truncated HOA representation ($\hat{C}_T(k)$) from the plurality of truncated HOA coefficient sequences ($\hat{z}_1(k), \ldots, \hat{z}_1(k)$), the gain control side information ($e_1(k), \beta_1(k), \ldots, e_I(k), \beta_I(k)$) and the assignment vector ($v_{AMB,ASSIGN}(k)$);

decomposing in Analysis Filter banks the reconstructed truncated HOA representation ($\hat{C}_T(k)$) into frequency subband representations ($\hat{\tilde{\mathbf{c}}}_T(k,f_1), \ldots, \hat{\tilde{\mathbf{c}}}_T(k,f_F)$) for a plurality of F frequency subbands;

synthesizing in Directional Subband Synthesis blocks for each of the frequency subband representations a predicted directional HOA representation ($\hat{\tilde{\mathbf{c}}}_D(k,f_1), \ldots, \hat{\tilde{\mathbf{c}}}_D(k,f_F)$) from the respective frequency subband representation ($\hat{\tilde{\mathbf{c}}}_T(k,f_1), \ldots, \hat{\tilde{\mathbf{c}}}_T(k,f_F)$) of the reconstructed truncated HOA representation, the subband related direction information ($M_{DIR}(k+1,f_1), \ldots, M_{DIR}(k+1,f_F)$) and the prediction matrices ($A(k+1,f_1), \ldots, A(k+1,f_F)$);

composing in Subband Composition blocks for each of the F frequency subbands a decoded subband HOA representation ($\hat{\tilde{\mathbf{c}}}(k,f_1), \ldots, \hat{\tilde{\mathbf{c}}}(k,f_F)$) with coefficient sequences ($\hat{\tilde{c}}_n(k,f_j)$, n=1, . . . , 0) that are either obtained from coefficient sequences of the truncated HOA representation ($\hat{\tilde{C}}_T(k,f_j)$) if the coefficient sequence has an index n that is included in the assignment vector ($v_{AMB,ASSIGN}(k)$), or otherwise obtained from coefficient sequences of the predicted directional HOA component ($\hat{\tilde{\mathbf{c}}}_D(k,f_j)$) provided by one of the Directional Subband Synthesis blocks; and synthesizing in Synthesis Filter banks the decoded subband HOA representations ($\hat{\tilde{\mathbf{c}}}(k,f_1), \ldots, \hat{\tilde{\mathbf{c}}}(k,f_F)$) to obtain the decoded HOA representation ($\hat{C}(k)$).

2. The method according to claim 1, wherein the extracting comprises obtaining a perceptually coded portion that comprises encoded truncated HOA coefficient sequences ($\check{z}_1(k), \ldots, \check{z}_I(k)$), and further comprises perceptually decoding in a perceptual decoder the encoded truncated HOA coefficient sequences ($\check{z}_1(k), \ldots, \check{z}_I(k)$) to obtain the truncated HOA coefficient sequences ($\hat{z}_1(k), \ldots, \hat{z}_I(k)$).

3. The method according to claim 1, wherein the extracting comprises obtaining an encoded side information portion, and further comprises decoding in a side information source decoder the encoded side information portion to obtain the subband related direction information ($M_{DIR}(k+1,f_1), \ldots, M_{DIR}(k+1,f_F)$), prediction matrices ($A(k+1,f_1), \ldots, A(k+1,f_F)$), gain control side information ($e_1(k), \beta_1(k), \ldots, e_I(k), \beta_I(k)$) and assignment vector ($v_{AMB,ASSIGN}(k)$).

4. The method according to claim 1, wherein the subband related direction information comprises a set of active directions ($M_{DIR}(k)$) and a tuple set ($M_{DIR}(k+1,f_1), \ldots, M_{DIR}(k+1,f_F)$) that comprises tuples of indices with a first and a second index, the second index being an index of an active direction within the set of active directions ($M_{DIR}(k)$) for a current frequency subband, and the first index being a trajectory index of the active direction, wherein a trajectory is a temporal sequence of directions of a particular sound source.

5. The method according to claim 1, wherein at least one frequency subband representation comprises a subband group of two or more frequency subbands.

6. The method according to claim 5, wherein subband group configuration information is received or extracted from the compressed HOA representation, and the subband group configuration information is used to set up said Synthesis Filter banks.

7. A method for encoding frames of an input HOA signal having a given number of coefficient sequences, where each coefficient sequence has an index, comprising determining a set of indices of active coefficient sequences ($I_{C,ACT}(k)$) to be included in a truncated HOA representation;

computing the truncated HOA representation ($C_T(k)$) having a reduced number of non-zero coefficient sequences;

estimating from the input HOA signal a first set of candidate directions ($M_{DIR}(k)$);

dividing the input HOA signal into a plurality of frequency subbands ($f_1, \ldots, f_F$), wherein coefficient sequences ($\tilde{\tilde{C}}(k-1, k, f_1), \ldots, \tilde{\tilde{C}}(k-1, k, f_F)$ of the frequency subbands are obtained;

estimating for each of the frequency subbands a second set of directions ($M_{DIR}(k,f_1), \ldots, M_{DIR}(k,f_F)$), wherein each element of the second set of directions is a tuple of indices with a first and a second index, the second index being an index of an active direction for a current frequency subband and the first index being a trajectory index of the active direction, wherein each active direction is also included in the first set of candidate directions ($M_{DIR}(k)$) of the input HOA signal;

for each of the frequency subbands, computing directional subband signals ($\tilde{\tilde{X}}(k-1, k, f_1), \ldots, \tilde{\tilde{X}}(k-1, k, f_F)$) from the coefficient sequences ($\tilde{\tilde{C}}(k-1, k, f_1), \ldots, \tilde{\tilde{C}}(k-1, k, f_F)$) of the frequency subband according to the second set of directions ($M_{DIR}(k,f_1), \ldots, M_{DIR}(k,f_F)$ of the respective frequency subband;

for each of the frequency subbands, calculating a prediction matrix ($A(k,f_1), \ldots, A(k,f_F)$) adapted for predicting the directional subband signals ($\tilde{\tilde{X}}(k-1, k, f_1), \ldots, \tilde{\tilde{X}}(k-1, k, f_F)$) from the coefficient sequences ($\tilde{\tilde{C}}(k-1, k, f_1), \ldots, \tilde{\tilde{C}}(k-1, k, f_F)$) of the frequency subband using the set of indices of active coefficient sequences ($I_{C,ACT}(k)$) of the respective frequency subband; and encoding the first set of candidate directions ($M_{DIR}(k)$), the second set of directions ($M_{DIR}(k,f_1), \ldots, M_{DIR}(k, f_F)$), the prediction matrices ($A(k,f_1), \ldots, A(k,f_F)$) and the truncated HOA representation ($C_T(k)$).

8. The method according to claim 7, wherein at least one group of two or more subbands is created, and wherein the at least one group is used instead of a single subband and is treated in the same way as a single subband.

9. The method according to claim 7, wherein said encoding the truncated HOA representation ($C_T(k)$) comprises partial decorrelation of the truncated HOA channel sequences;

channel assignment for assigning the truncated HOA channel sequences ($y_1(k), \ldots, y_I(k)$) to transport channels;

performing gain control on each of the transport channels, wherein gain control side information ($e_i(k-1)$, $\beta_i(k-1)$) for each transport channel is generated;

encoding the gain controlled truncated HOA channel sequences ($z_1(k), \ldots, z_I(k)$) in a perceptual encoder;

encoding the gain control side information ($e_i(k-1)$, $\beta_i(k-1)$), the first set of candidate directions ($M_{DIR}(k)$), the second set of directions ($M_{DIR}(k, f_1), \ldots, M_{DIR}(k,f_F)$) and the prediction matrices ($A(k,f_1), \ldots, A(k,f_F)$) in a side information source coder; and multiplexing the outputs of the perceptual encoder and the side information source coder to obtain an encoded HOA signal frame ($\check{B}(k-1)$).

10. The method according to claim 7, wherein in the step of estimating for each of the frequency subbands the second set of directions ($M_{DIR}(k,f_1), \ldots, M_{DIR}(k, f_F)$), the directions of a frequency subband are searched only among the directions ($M_{DIR}(k)$) of the full band HOA signal.

11. The method according to claim 7, further comprising a step of determining a trajectory of an active direction, wherein an active direction is a direction of a sound source and wherein a trajectory is a temporal sequence of directions of a particular sound source.

12. The method according to claim 7, wherein a truncated HOA representation is a HOA signal in which one or more coefficient sequences are set to zero.

13. An apparatus for decoding a HOA signal, comprising an Extraction module configured to extract from the compressed HOA representation a plurality of truncated HOA coefficient sequences ($\hat{z}_1(k), \ldots, \hat{z}_I(k)$), an assignment vector ($v_{AMB,ASSIGN}(k)$) indicating or containing sequence indices of said truncated HOA coefficient sequences, subband related direction information ($M_{DIR}(k+1,f_1), \ldots, M_{DIR}(k+1,f_F)$), a plurality of prediction matrices ($A(k+1,f_1), \ldots, A(k+1,f_F)$), and gain control side information ($e_1(k), \beta_1(k), \ldots, e_I(k), \beta_I(k)$);

a Reconstruction module configured to reconstruct a truncated HOA representation ($\hat{C}_T(k)$) from the plurality of truncated HOA coefficient sequences ($\hat{z}_1(k), \ldots, \hat{z}_I(k)$), the gain control side information ($e_1(k), \beta_1(k), \ldots, e_I(k), \beta_I(k)$) and the assignment vector ($v_{AMB,ASSIGN}(k)$;

an Analysis Filter bank module configured to decompose the reconstructed truncated HOA representation ($\hat{C}_T(k)$) into frequency subband representations ($\hat{\tilde{\tilde{c}}}_T(k, f_1), \ldots, \hat{\tilde{\tilde{c}}}_T(k, f_F)$) for a plurality of F frequency subbands;

at least one Directional Subband Synthesis module configured to synthesize for each of the frequency subband representations a predicted directional HOA representation ($\hat{\tilde{\tilde{c}}}_D(k,f_1), \ldots, \hat{\tilde{\tilde{c}}}_D(k,f_F)$) from the respective frequency subband representation ($\hat{\tilde{\tilde{c}}}_T(k,f_1), \ldots, \hat{\tilde{\tilde{c}}}_T(k,f_F)$) of the reconstructed truncated HOA representation, the subband related direction information ($M_{DIR}(k+1,f_1), \ldots, M_{DIR}(k+1,f_F)$) and the prediction matrices ($A(k+1,f_1), \ldots, A(k+1,f_F)$;

at least one Subband Composition module configured to compose for each of the F frequency subbands a decoded subband HOA representation ($\hat{\tilde{\tilde{c}}}(k,f_1), \ldots, \hat{\tilde{\tilde{c}}}(k, f_F)$) with coefficient sequences ($\hat{c}_n(k,f_j)$, $n=1, \ldots, 0$) that are either obtained from coefficient sequences of the truncated HOA representation ($\hat{\tilde{\tilde{c}}}_T(k,$ $f_j$)) if the coefficient sequence has an index n that is included in the assignment vector ($v_{AMB,ASSIGN}$(k)), or otherwise obtained from coefficient sequences of the predicted directional HOA component ($\hat{\tilde{c}}_D$(k,$f_j$)) provided by one of the Directional Subband Synthesis module; and a Synthesis Filter bank module configured to synthesize the decoded subband HOA representations ($\hat{\tilde{c}}$(k,$f_1$), . . . , $\hat{\tilde{c}}$(k,$f_F$)) to obtain the decoded HOA representation ($\hat{C}$(k)).

14. The apparatus according to claim 13, wherein the Extraction module comprises at least a Demultiplexer for obtaining an encoded side information portion and a perceptually coded portion that comprises encoded truncated HOA coefficient sequences ($\check{z}_1$(k), . . . , $\check{z}_I$(k));

a Perceptual Decoder configured to perceptually decode the encoded truncated HOA coefficient sequences ($\check{z}_1$(k), . . . , $\check{z}_1$(k)) to obtain the truncated HOA coefficient sequences ($\hat{z}_1$(k), . . . , $\hat{z}_1$(k)); and a Side Information Source Decoder configured to decode the encoded side information portion to obtain the subband related direction information ($M_{DIR}$(k+1, $f_1$), . . . , $M_{DIR}$(k+1,$f_F$), prediction matrices (A(k+1,$f_1$), . . . , A(k+1,$f_F$)), gain control side information ($e_1$(k), $\beta_1$(k), . . . , $e_I$(k), $\beta_I$(k)) and assignment vector ($v_{AMB,ASSIGN}$(k)).

15. The apparatus according to claim 13, wherein the Extraction module obtains an encoded side information portion, further comprising a side information source decoder configured to decode the encoded side information portion to obtain the subband related direction information ($M_{DIR}$(k+1,$f_1$), . . . , $M_{DIR}$(k+1, $f_F$)), prediction matrices (A(k+1,$f_1$), . . . , A(k+1,$f_F$)), gain control side information ($e_1$(k), $\beta_1$(k), . . . , $e_I$(k), $\beta_I$(k)) and assignment vector ($v_{AMB,ASSIGN}$(k)).

16. The apparatus according to claim 13, wherein the subband related direction information comprises a set of active directions ($M_{DIR}$(k)) and a tuple set ($M_{DIR}$(k+1,$f_1$), . . . , $M_{DIR}$(k+1,$f_F$) that comprises tuples of indices with a first and a second index, the second index being an index of an active direction within the set of active directions ($M_{DIR}$(k)) for a current frequency subband, and the first index being a trajectory index of the active direction, wherein a trajectory is a temporal sequence of directions of a particular sound source.

17. The apparatus according to claim 13, wherein at least one frequency subband representation comprises a subband group of two or more frequency subbands.

18. The apparatus according to claim 17, wherein subband group configuration information is received or extracted from the compressed HOA representation, and the subband group configuration information is used to set up said Synthesis Filter banks.

19. An apparatus for encoding frames of an input HOA signal having a given number of coefficient sequences, where each coefficient sequence has an index, comprising a computation and determining module configured to compute a truncated HOA representation ($C_T$(k)) having a reduced number of non-zero coefficient sequences, and further configured to determine a set of indices of active coefficient sequences ($I_{C,ACT}$(k)) included in the truncated HOA representation;

an Analysis Filter bank module configured to divide the input HOA signal into a plurality of frequency subbands ($f_1$, . . . , $f_F$), wherein coefficient sequences ($\tilde{\tilde{C}}$(k−1, k, $f_1$), . . . , $\tilde{\tilde{C}}$(k−1, k, $f_F$) of the frequency subbands are obtained;

a Direction Estimation module configured to estimate from the input HOA signal a first set of candidate directions ($M_{DIR}$(k)), and further configured to estimate for each of the frequency subbands a second set of directions $M_{DIR}$(k,$f_1$), . . . , $M_{DIR}$(k,$f_F$)), wherein each element of the second set of directions is a tuple of indices with a first and a second index, the second index being an index of an active direction for a current frequency subband and the first index being a trajectory index of the active direction, wherein each active direction is also included in the first set of candidate directions ($M_{DIR}$(k)) of the input HOA signal;

at least one Directional Subband Computation module configured to compute, for each of the frequency subbands, directional subband signals ($\tilde{\tilde{X}}$(k−1,k,$f_1$), . . . , $\tilde{\tilde{X}}$(k−1,k,$f_F$)) from the coefficient sequences ($\tilde{\tilde{C}}$(k−1,k,$f_1$), . . . , $\tilde{\tilde{C}}$(k−1,k,$f_F$)) of the frequency subband according to the second set of directions ($M_{DIR}$(k,$f_1$), . . . , $M_{DIR}$(k $f_F$)) of the respective frequency subband;

at least one Directional Subband Prediction module configured to calculate, for each of the frequency subbands, a prediction matrix (A(k,$f_1$), . . . , A(k,$f_F$)) adapted for predicting the directional subband signals ($\tilde{\tilde{X}}$(k−1,k,$f_1$), . . . , $\tilde{\tilde{X}}$(k−1,k,$f_F$)) from the coefficient sequences ($\tilde{\tilde{C}}$(k−1,k,$f_1$), . . . , $\tilde{\tilde{C}}$(k−1,k,$f_F$)) of the frequency subband using the set of indices of active coefficient sequences ($I_{C,ACT}$(k)) of the respective frequency subband; and encoding module configured to encode the first set of candidate directions ($M_{DIR}$(k)), the second set of directions $M_{DIR}$(k,$f_1$), . . . , $M_{DIR}$(k,$f_F$)), the prediction matrices (A(k,$f_1$), . . . , A(k,$f_F$)) and the truncated HOA representation ($C_T$(k)).

20. The apparatus according to claim 19, wherein at least one group of two or more subbands is created, and wherein the at least one group is used instead of a single subband and is treated in the same way as a single subband.

21. The apparatus according to claim 19, further comprising a partial decorrelator configured to partially decorrelate the truncated HOA channel sequences;

a Channel Assignment module configured to assigning the truncated HOA channel sequences ($y_1$(k), . . . , $y_I$(k)) to transport channels; and at least one Gain Control unit configured to perform gain control on the transport channels, wherein gain control side information ($e_i$(k−1), $\beta_i$(k−1)) for each transport channel is generated;

and wherein the encoding module comprises a Perceptual Encoder configured to encode the gain controlled truncated HOA channel sequences ($z_1$(k), . . . , $z_I$(k));

a Side Information Source Coder configured to encode the gain control side information ($e_i$(k−1), $\beta_i$(k−1)), the first set of candidate directions ($M_{DIR}$(k)), the second set of directions ($M_{DIR}$(k,$f_1$), . . . , $M_{DIR}$(k,$f_F$)) and the prediction matrices (A(k,$f_1$), . . . , A(k,$f_F$)); and a Multiplexer configured to multiplex the outputs of the perceptual encoder and the side information source coder to obtain an encoded HOA signal frame ($\check{B}$(k−1)).

22. The apparatus according to claim 19, wherein the Direction Estimation module, when estimating for each of the frequency subbands the second set of directions ($M_{DIR}(k,f_1)$, . . . , $M_{DIR}(k,f_F)$), searches the directions of a frequency subband only among the directions ($M_{DIR}(k)$) of the full band HOA signal.

23. The apparatus according to claim 19, further comprising a trajectory determining module configured to determine a trajectory of an active direction, wherein an active direction is a direction of a sound source and wherein a trajectory is a temporal sequence of directions of a particular sound source.

24. The apparatus according to claim 19, wherein a truncated HOA representation is a HOA signal in which one or more coefficient sequences are set to zero.

* * * * *